US011663965B2

(12) United States Patent
Feng et al.

(10) Patent No.: US 11,663,965 B2
(45) Date of Patent: May 30, 2023

(54) ORGANIC LIGHT-EMITTING DIODE DISPLAY SUBSTRATE AND ORGANIC LIGHT-EMITTING DIODE DISPLAY DEVICE

(71) Applicants: Hefei BOE Joint Technology Co., Ltd., Anhui (CN); BOE Technology Group Co., Ltd., Beijing (CN)

(72) Inventors: Xuehuan Feng, Beijing (CN); Yongqian Li, Beijing (CN); Yubao Kong, Beijing (CN)

(73) Assignees: Hefei BOE Joint Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/468,705

(22) Filed: Sep. 8, 2021

(65) Prior Publication Data

US 2021/0407391 A1 Dec. 30, 2021

Related U.S. Application Data

(63) Continuation-in-part of application No. 16/914,485, filed on Jun. 29, 2020, now Pat. No. 11,132,947.

(30) Foreign Application Priority Data

Aug. 9, 2019 (CN) ..... 201910735224.X

(51) Int. Cl.
*G09G 3/30* (2006.01)
*G09G 3/3208* (2016.01)
(Continued)

(52) U.S. Cl.
CPC ..... *G09G 3/3208* (2013.01); *G09G 3/3233* (2013.01); *G09G 3/3266* (2013.01);
(Continued)

(58) Field of Classification Search
CPC .. G09G 3/3208; G09G 3/3233; G09G 3/3266; G09G 2310/0286; G09G 2310/08; G09G 2320/0233; G09G 2330/021
See application file for complete search history.

(56) References Cited

U.S. PATENT DOCUMENTS 5,940,059 A 8/1999 Lee et al.
2003/0086048 A1 5/2003 Ukita
(Continued)

FOREIGN PATENT DOCUMENTS

CN 1416001 A 5/2003
CN 101071245 A 11/2007
(Continued)

OTHER PUBLICATIONS

Office Action dated May 25, 2020 for Chinese Patent Application No. 201910735224.X and English Translation.
(Continued)

*Primary Examiner* — Adam J Snyder
(74) *Attorney, Agent, or Firm* — Ling Wu; Stephen Yang; Ling and Yang Intellectual Property

(57) ABSTRACT

Disclosed are a display substrate and a display device. A display region and a peripheral region are included. The peripheral region includes a plurality of shift registers and a plurality of clock signal lines. The plurality of clock signal lines are arranged side by side in a first direction and include a first clock signal line to a Zth clock signal line, Z≥1. The shift registers are connected with gate lines in the display region and the first clock signal line to the Zth clock signal line respectively. There is at least a group of ith clock signal lines satisfying that the ith clock signal lines include X ith clock signal lines which are arranged one by one according to a sequence of connection with shift registers and further include N ith clock signal lines.

16 Claims, 13 Drawing Sheets

(51) Int. Cl.
*G09G 3/3233* (2016.01)
*G09G 3/3266* (2016.01)

(52) U.S. Cl.
CPC . *G09G 2310/0286* (2013.01); *G09G 2310/08* (2013.01); *G09G 2320/0233* (2013.01); *G09G 2330/021* (2013.01)

(56) References Cited

U.S. PATENT DOCUMENTS

| | | | | |
|---|---|---|---|---|
| 2013/0278567 | A1* | 10/2013 | Chang | G09G 3/3677 345/204 |
| 2014/0333592 | A1 | 11/2014 | Cho et al. | |
| 2016/0335949 | A1 | 11/2016 | Lin et al. | |
| 2016/0372024 | A1 | 12/2016 | Lim et al. | |
| 2017/0124972 | A1 | 5/2017 | Kim et al. | |
| 2018/0005582 | A1 | 1/2018 | Takahara | |
| 2021/0056881 | A1* | 2/2021 | Yeh | G09G 3/20 |

FOREIGN PATENT DOCUMENTS

| | | | |
|---|---|---|---|
| CN | 101667388 | A | 3/2010 |
| CN | 101777301 | A | 7/2010 |
| CN | 201716962 | U | 1/2011 |
| CN | 103198802 | A | 7/2013 |
| CN | 105161042 | A | 12/2015 |
| CN | 105761662 | A | 7/2016 |
| CN | 106297680 | A | 1/2017 |
| CN | 108490708 | A | 9/2018 |
| CN | 109272921 | A | 1/2019 |

OTHER PUBLICATIONS

Office Action dated Jul. 9, 2020 for Chinese Patent Application No. 201910735224.X and English Translation.
Office Action dated Mar. 16, 2021 for U.S. Appl. No. 16/914,485.

* cited by examiner

ORGANIC LIGHT-EMITTING DIODE DISPLAY SUBSTRATE AND ORGANIC LIGHT-EMITTING DIODE DISPLAY DEVICE

CROSS-REFERENCE TO RELATED APPLICATION

The present application is a continuation-in-part application of U.S. application Ser. No. 16/914,485, filed on Jun. 29, 2020, and claims the priority to Chinese patent application No. 201910735224.X, filed on Aug. 9, 2019, all the contents of which are hereby incorporated by reference.

TECHNICAL FIELD

Embodiments of the present disclosure relate to, but not limited to the field of display technologies, and particularly to a display substrate and a display device.

BACKGROUND

As one of hot spots in the field of Flat Panel Display (FPD) researches at present, Organic Light-Emitting Diode (OLED) has the advantages of power saving, ultra-thin thickness, light weight, autoluminescence, no viewing angle limits, quick response, high photoelectric efficiency, no need of backlight structures and color filter structures, high contrast, high luminance efficiency, high brightness, multicolor and color (Red Green Blue (RGB)) component manufacturing capability, wide operating temperature range, etc., and has been applied extensively to the fields of display of mobile phones, tablet computers, digital cameras, etc.

An OLED display panel includes a pixel driving circuit and a Gate Driver on Array (GOA) circuit. The GOA circuit is configured to provide a scanning signal for the pixel driving circuit. The pixel driving circuit is configured to drive an OLED in the OLED display panel to emit light to implement displaying. The gate driver on array circuit includes a plurality of shift registers, of which each is configured to provide scanning signals for pixel driving circuits of a row.

SUMMARY

The below is a summary about the subject matter described in the present disclosure in detail. The summary is not intended to limit the scope of protection of the claims.

An embodiment of the present disclosure provides a display substrate, which includes a display region and a peripheral region. The peripheral region includes a plurality of shift registers and a plurality of clock signal lines. The plurality of clock signal lines are arranged side by side in a first direction and include a first clock signal line to a Zth clock signal line, Z being a positive integer. The shift registers are connected with gate lines in the display region and the first clock signal line to the Zth clock signal line respectively. There is at least a group of ith clock signal lines satisfying that the ith clock signal lines include X ith clock signal lines which are arranged one by one according to a sequence of connection with shift registers and further include N ith clock signal lines which are arranged, through an wiring sequence adjusting, in a manner that an impedance difference between the ith clock signal lines connected with any two adjacent shift registers in the shift registers connected with the (X+N) ith clock signal lines is less than or equal to an impedance threshold, i being an integer from 1 to Z, X being an integer greater than 2, and N being a positive integer.

In an exemplary embodiment, the impedance threshold is $k*\Delta R$, where k is an integer from 2 to (X+N−2), and $\Delta R$ is an impedance difference between clock signal lines connected with two adjacent groups of shift registers.

In an exemplary embodiment, the N ith clock signal lines are on a side of the X ith clock signal lines away from the display region.

In an exemplary embodiment, the N ith clock signal lines are on a side of the X ith clock signal lines close to the display region.

In an exemplary embodiment, there is at least a group of jth clock signal lines satisfying that the jth clock signal lines include J jth clock signal lines which are arranged one by one according to a sequence of connection with shift registers, j being an integer from 1 to Z, $i \neq j$, and J being an integer greater than 2.

In an exemplary embodiment, both the ith clock signal line and the jth clock signal line are on one side of the shift register.

In an exemplary embodiment, the ith clock signal lines include a plurality of first groups. Each first group includes a plurality of ith clock signal lines arranged adjacently in the first direction. The plurality of first groups are arranged, through a wiring sequence of the ith clock signal lines in each first group being adjusted, in a manner that an impedance difference between the ith clock signal lines connected with any two adjacent shift registers in the shift registers connected with the (X+N) ith clock signal lines is less than or equal to the impedance threshold.

In an exemplary embodiment, the ith clock signal lines include a plurality of second groups. Each second group includes a plurality of ith clock signal lines arranged adjacently in the first direction. The ith clock signal lines in each second group are arranged one by one according to a sequence of connection with shift registers.

In an exemplary embodiment, the shift registers include a plurality of groups of which each includes (X+N) shift registers. (X+N) adjacent shift registers are correspondingly connected with the (X+N) ith clock signal lines one to one.

In an exemplary embodiment, the X ith clock signal lines include ith clock signal line 1 to ith clock signal line 12, and the N ith clock signal lines include ith clock signal line 13 to ith clock signal line 16.

Herein, ith clock signal line 1 to ith clock signal line 12 are arranged one by one according to a sequence of connection with shift registers, and ith clock signal line 13 to ith clock signal line 16 are arranged in a sequence of ith clock signal line 14, ith clock signal line 13, ith clock signal line 16 and ith clock signal line 15.

In an exemplary embodiment, the N ith clock signal lines include ith clock signal line 1 to ith clock signal line 4, and the X ith clock signal lines include ith clock signal line 5 to ith clock signal line 16.

Herein, ith clock signal line 5 to ith clock signal line 16 are arranged one by one according to a sequence of connection with shift registers, and ith clock signal line 1 to ith clock signal line 4 are arranged in a sequence of ith clock signal line 2, ith clock signal line 1, ith clock signal line 4 and ith clock signal line 3.

In an exemplary embodiment, a wiring sequence of the N ith clock signal lines satisfies that impedance differences between ith clock signal line n1 and ith clock signal line (n1+1) and between ith clock signal line 1 and ith clock signal line N are ΔR or 2*ΔR respectively, n1 being an integer from 1 to (N−1).

In an exemplary embodiment, the first direction is a direction close to a first shift register. When N is an even number, a wiring sequence of the N ith clock signal lines in the first direction is sequentially ith clock signal line 1, ith clock signal line 2, ith clock signal line N, ith clock signal line 3, ith clock signal line (N−1), . . . , ith clock signal line $$\frac{N}{2},$$

ith clock signal line $$\left(\frac{N}{2}+2\right),$$

and ith clock signal line $$\left(\frac{N}{2}+1\right).$$

Or, a wiring sequence of the N ith clock signal lines in the first direction is sequentially ith clock signal line 2, ith clock signal line 1, ith clock signal line 3, ith clock signal line N, ith clock signal line 4, ith clock signal line (N−1), . . . , ith clock signal line $$\frac{N}{2},$$

ith clock signal line $$\left(\frac{N}{2}+3\right),$$

ith clock signal line $$\left(\frac{N}{2}+1\right),$$

and ith clock signal line $$\left(\frac{N}{2}+2\right).$$

In an exemplary embodiment, the first direction is a direction close to a first shift register. When N is an even number, a wiring sequence of the N ith clock signal lines in the first direction is sequentially ith clock signal line 1, ith clock signal line N, ith clock signal line 2, ith clock signal line (N−1), ith clock signal line 3, . . . , ith clock signal line $$\left(\frac{N}{2}+2\right),$$

ith clock signal line $$\frac{N}{2},$$

and ith clock signal line $$\left(\frac{N}{2}+1\right).$$

Or, a wiring sequence of the N ith clock signal lines in the first direction is sequentially ith clock signal line N, ith clock signal line 1, ith clock signal line (N−1), ith clock signal line 2, ith clock signal line (N−2), ith clock signal line 3, . . . , ith clock signal line $$\left(\frac{N}{2}+2\right),$$

ith clock signal line $$\left(\frac{N}{2}-1\right),$$

ith clock signal line $$\left(\frac{N}{2}+1\right),$$

and ith clock signal line $$\frac{N}{2}.$$

In an exemplary embodiment, the first direction is a direction close to a first shift register. When N is an odd number, a wiring sequence of the N ith clock signal lines in the first direction is sequentially ith clock signal line 1, ith clock signal line 2, ith clock signal line N, ith clock signal line 3, ith clock signal line (N−1), . . . , ith clock signal line $$\left(\frac{N+1}{2}+2\right),$$

ith clock signal line $$\frac{N+1}{2},$$

and ith clock signal line $$\left(\frac{N+1}{2}+1\right).$$

Or, a wiring sequence of the N ith clock signal lines in the first direction is sequentially ith clock signal line 2, ith clock signal line 1, ith clock signal line 3, ith clock signal line N, ith clock signal line 4, ith clock signal line (N−1), . . . , ith clock signal line $$\frac{N+1}{2},$$

ith clock signal line $$\left(\frac{N+1}{2}+2\right),$$

and ith clock signal line $$\left(\frac{N+1}{2}+1\right).$$

In an exemplary embodiment, the first direction is a direction close to a first shift register. When N is an odd number, a wiring sequence of the N ith clock signal lines in the first direction is sequentially ith clock signal line 1, ith clock signal line N, ith clock signal line 2, ith clock signal line (N−1), ith clock signal line 3, . . . , ith clock signal line $$\left(\frac{N+1}{2}-1\right),$$

ith clock signal line $$\left(\frac{N+1}{2}+1\right),$$

and ith clock signal line $$\frac{N+1}{2}.$$

Or, a wiring sequence of the N ith clock signal lines in the first direction is sequentially ith clock signal line N, ith clock signal line 1, ith clock signal line (N−1), ith clock signal line 2, ith clock signal line (N−2), ith clock signal line 3, . . . , ith clock signal line $$\left(\frac{N+1}{2}+1\right),$$

ith clock signal line $$\left(\frac{N+1}{2}-1\right),$$

and ith clock signal line $$\frac{N+1}{2}.$$

An embodiment of the present disclosure also provides a display device, which includes any abovementioned display substrate.

Other aspects will become apparent upon reading and understanding the accompanying drawings and detailed description.

BRIEF DESCRIPTION OF DRAWINGS

The drawings provide an understanding to the technical solution of the embodiments of the present disclosure, form a part of the specification, and are adopted to explain, together with the embodiments of the present disclosure, the technical solutions of the embodiments of the present disclosure and not intended to form limits to the technical solutions of the embodiments of the present disclosure.

DETAILED DESCRIPTION

Figure 1:
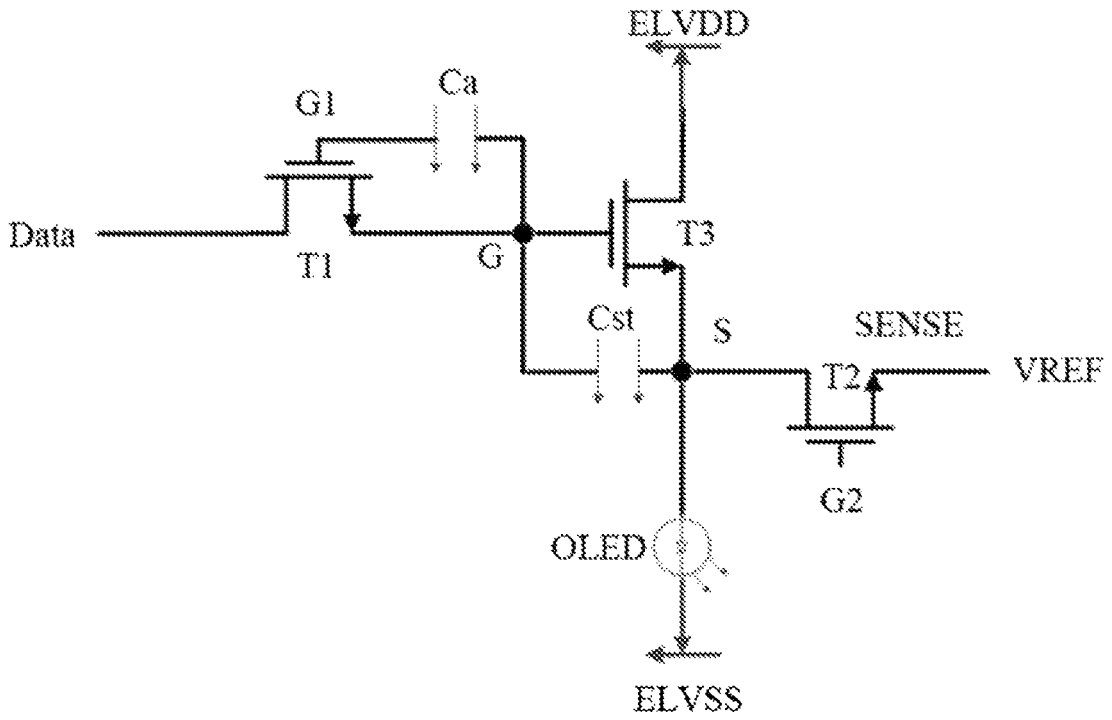
FIG. 1 is a schematic diagram of a pixel driving circuit.

A plurality of embodiments are described in the present invention. However, the description is exemplary and unrestrictive. Moreover, it is apparent to those of ordinary skill in the art that there may be more embodiments and implementation solutions in the scope of the embodiments described in the present invention. Although many possible feature combinations are shown in the drawings and discussed in specific implementation modes, the disclosed features may also be combined in many other manners. Unless specifically restricted, any feature or element of any embodiment may be combined with any other feature or element in any other embodiment for use, or may take the place of any other feature or element in any other embodiment.

The present disclosure includes and conceives combinations of features and elements well known to those of ordinary skill in the art. The embodiments, features, and elements that have been disclosed in the present invention may also be combined with any conventional features or elements to form unique inventive solutions defined by the claims. Any feature or element of any embodiment may also be combined with a feature or element from another inventive solution to form another unique inventive solution defined by the claims. Therefore, it should be understood that any feature shown or discussed in the present invention may be implemented independently or in any appropriate combination. Therefore, no other limits are made to the embodiments, besides limits made by the appended claims and equivalent replacements thereof. In addition, various modifications and variations may be made within the scope of protection of the appended claims.

In addition, when a representative embodiment is described, a method or a process may already be presented as a specific step sequence in the specification. However, the method or the process should not be limited to the steps of the specific sequence on the premise that the method or the process is independent of the specific sequence of the steps. As understood by those of ordinary skill in the art, other step sequences are also possible. Therefore, the specific sequence of the steps described in the specification should not be explained as a limit to the claims. Moreover, execution of the steps of the method of the process in the claims for the method or the process should not be limited to the written sequence, and it can be easily understood by those skilled in the art that these sequences may be changed and still fall within the spirit and scope of the embodiments of the present invention.

FIG. 1 is an equivalent circuit diagram of a pixel driving circuit. As shown in FIG. 1, the pixel driving circuit includes a first transistor T1, a second transistor T2, a third transistor T3, a first capacitor Ca, and a second capacitor Cst. T1 and T2 are switch transistors. T3 is a drive transistor. The first capacitor Ca is a coupling capacitor. The second capacitor Cst is a memory capacitor. A gate of the first transistor T1 is connected to a first control signal terminal G1, a source of the first transistor T1 is connected to a data signal terminal DATA, and a drain of the first transistor T1 is connected with a node G. One end of the first capacitor Ca is connected with the first control signal terminal G1, and the other end of the first capacitor Ca is connected with the node G. One end of the second capacitor Cst is connected with the node G, and the other end of the second capacitor Cst is connected with a node S. A gate of the second transistor T2 is connected to a second control signal terminal G2, a drain of the second transistor T2 is connected with the node S, and a source of the second transistor T2 is connected to a sensing signal terminal SENSE. A gate of the third transistor T3 is connected with the node G, a drain of the third transistor T3 is connected to a power signal terminal ELVDD, and a source of the third transistor T3 is connected to an anode of an Organic Light-Emitting Diode (OLED). A cathode of the Organic Light-Emitting Diode (OLED) is connected to a signal common end ELVSS.

A working process of the pixel driving circuit includes the following operations. Active levels are provided for the first control signal terminal G1 and the second control signal terminal G2 to turn on the first transistor T1 and the second transistor T2 to provide a signal of the data signal terminal DATA for the node G and provide, for the node S, a signal of the sensing signal terminal SENSE, of which a voltage value is a reference voltage. Then, inactive levels are provided for the first control signal terminal G1 and the second control signal terminal G2 to turn off the first transistor T1 and the second transistor T2 and turn on the third transistor T3 to provide a driving current for the OLED to drive the OLED to emit light.

When the inactive level is provided for the first control signal terminal G1 in this process, there is a coupling between the first capacitor Ca and the second capacitor Cst such that a potential variation ΔVp of the node G satisfies $\Delta Vp=\Delta V1*Cst/(Cst+Ca)$. However, ΔVp is also affected by a falling edge of a signal of the first control signal terminal G1. If the falling edge of the signal of the first control signal terminal G1 is greater, ΔVp is less.

Figure 2:
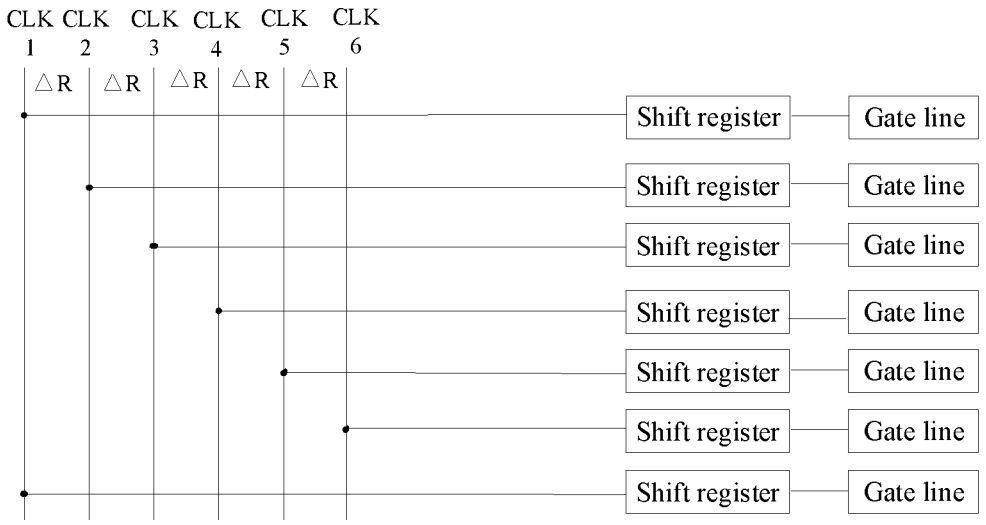
FIG. 2 is a schematic arrangement diagram of clock signal lines of a display substrate.

A display substrate includes a plurality of shift registers. Each shift register provides a scanning signal for pixel driving circuits of a row. Pixel driving circuits of each row are connected with one or more gate lines. Considering the power consumption and the reliability, a plurality of clock signal lines may usually be connected with a gate driver on array circuit in a large-sized OLED. Since impedance differences between clock signal lines connected with adjacent shift registers are different during wiring due to a relatively large number of clock signal lines, falling edges of signals generated by a first control signal terminal G1 have difference to further affect ΔVp and result in periodic horizontal stripes of a display panel related to the clock signal lines. FIG. 2 is described taking six clock signal ends as an example. There is a difference of 5*ΔR between a clock signal line CLK6 connected with a shift register of a sixth stage and a clock signal line CLK1 connected with a shift register of a seventh stage, where ΔR is an impedance difference between clock signal lines of adjacent wiring spaces. Therefore, a dividing line is formed at a boundary of rows corresponding to the clock signal line CLK1 and the clock signal line CLK6 due to a brightness difference, namely in the display panel a periodic horizontal stripe is generated, which affects a display effect of the display panel.

As shown in FIG. 3A, 3B, 4A, 4B, 7 or 8, a display substrate according to an embodiment of the present disclosure includes a display region and a peripheral region. The peripheral region includes a plurality of shift registers and a plurality of clock signal lines. The plurality of clock signal lines are arranged side by side in a first direction and include a first clock signal line to a Zth clock signal line, Z being a positive integer. The shift registers are connected with gate lines in the display region and the first clock signal line to the Zth clock signal line respectively.

There is at least a group of ith clock signal lines satisfying that the ith clock signal lines include X ith clock signal lines which are arranged one by one according to a sequence of connection with shift registers and further include N ith clock signal lines which are arranged in a manner through a wiring sequence adjusting that an impedance difference between the ith clock signal lines connected with any two adjacent shift registers in the shift registers connected with the (X+N) ith clock signal lines is less than or equal to an impedance threshold, i being an integer from 1 to Z, X being an integer greater than 2, and N being a positive integer.

According to the display substrate provided in the embodiment of the present disclosure, periodic horizontal stripes generated in a display panel are eliminated effectively, and a display effect is improved.

In an exemplary embodiment, the impedance threshold is k*ΔR, where k is an integer from 2 to (X+N−2), and ΔR is an impedance difference between clock signal lines connected with two adjacent groups of shift registers, i.e., an impedance difference caused by different distances from clock signal lines of adjacent wiring spaces to different shift registers.

Exemplarily, k may be 14, 13, or the like if X=12 and N=4.

In an exemplary embodiment, the N ith clock signal lines are on a side of the X ith clock signal lines away from the display region.

In an exemplary embodiment, the X ith clock signal lines are on a side of the N ith clock signal lines away from the display region.

In an exemplary embodiment, there is at least a group of jth clock signal lines satisfying that the jth clock signal lines include J jth clock signal lines which are arranged one by one according to a sequence of connection with shift registers, j being an integer from 1 to Z, i≠j, and J being an integer greater than 2.

In an exemplary embodiment, both the ith clock signal lines and the jth clock signal lines are on one side of the shift register.

In an exemplary embodiment, the ith clock signal lines include a plurality of first groups. Each first group includes a plurality of ith clock signal lines arranged adjacently in the first direction. The plurality of first groups are arranged in a manner, through a wiring sequence of the ith clock signal lines in each first group being adjusted, that an impedance difference between the ith clock signal lines connected with any two adjacent shift registers in the shift registers connected with the (X+N) ith clock signal lines is less than or equal to the impedance threshold.

In an exemplary embodiment, the ith clock signal lines include a plurality of second groups. Each second group includes a plurality of ith clock signal lines arranged adjacently in the first direction. The ith clock signal lines in each second group are arranged one by one according to a sequence of connection with shift registers.

In an exemplary embodiment, there are a plurality of groups of the shift registers, each group includes (X+N) shift registers. (X+N) adjacent shift registers are correspondingly connected with the (X+N) ith clock signal lines one to one.

In an exemplary embodiment, as shown in FIG. 3A, 3B, 4A, 4B, 7 or 8, a wiring sequence of the N ith clock signal lines satisfies that impedance differences between ith clock signal line n1 and ith clock signal line (n1+1) and between ith clock signal line 1 and ith clock signal line N are ΔR or 2*ΔR respectively, i being an integer from 1 to N−1.

For a small-sized Flat Panel Display (FPD) product, loads of gate lines are relatively low, so a shift register cross driving mode may usually be adopted. That is, shift registers on one side drive the gate lines of odd rows, shift registers on the other side drive the gate lines of even rows, and the shift registers on the left and the right are interleaved in time without mutual interferences, to achieve an effect of sequentially turning on the gate lines. This is called single-side drive. Therefore, the border width and the power consumption may be reduced.

In the abovementioned technology, ith clock signal line 1 CLK1 is connected with shift registers of a first stage, an (N+1) the stage, a (2N+1)th stage, a (3N+1)th stage, . . . , ith clock signal line 2 CLK2 is connected with shift registers of a second stage, an (N+2)th stage, a (2N+2)th stage, a (3N+2)th stage, . . . , ith clock signal line 3 CLK3 is connected with shift registers of a third stage, an (N+3)th stage, a (2N+3)th stage, a (3N+3)th stage, . . . , and ith clock signal line N CLKN is connected with shift registers of an Nth stage, a 2Nth stage, a 3Nth stage, a 4Nth stage, . . . .

According to the display substrate of the embodiment of the present disclosure, the wiring sequence of the clock signal lines CLK is no longer according to a regular sequence of CLK1 to CLKN but in a manner that a resistance difference of adjacent clock signal lines CLK is not greater than 2*ΔR. Such a difference is beyond a brightness change perceivable to human eyes. In addition, the method is more effective for a plurality of outputs CLK with a high resolution and a high Pixels Per Inch (PPI).

In an exemplary embodiment, the first direction is a direction close to the shift register.

Figure 3A:
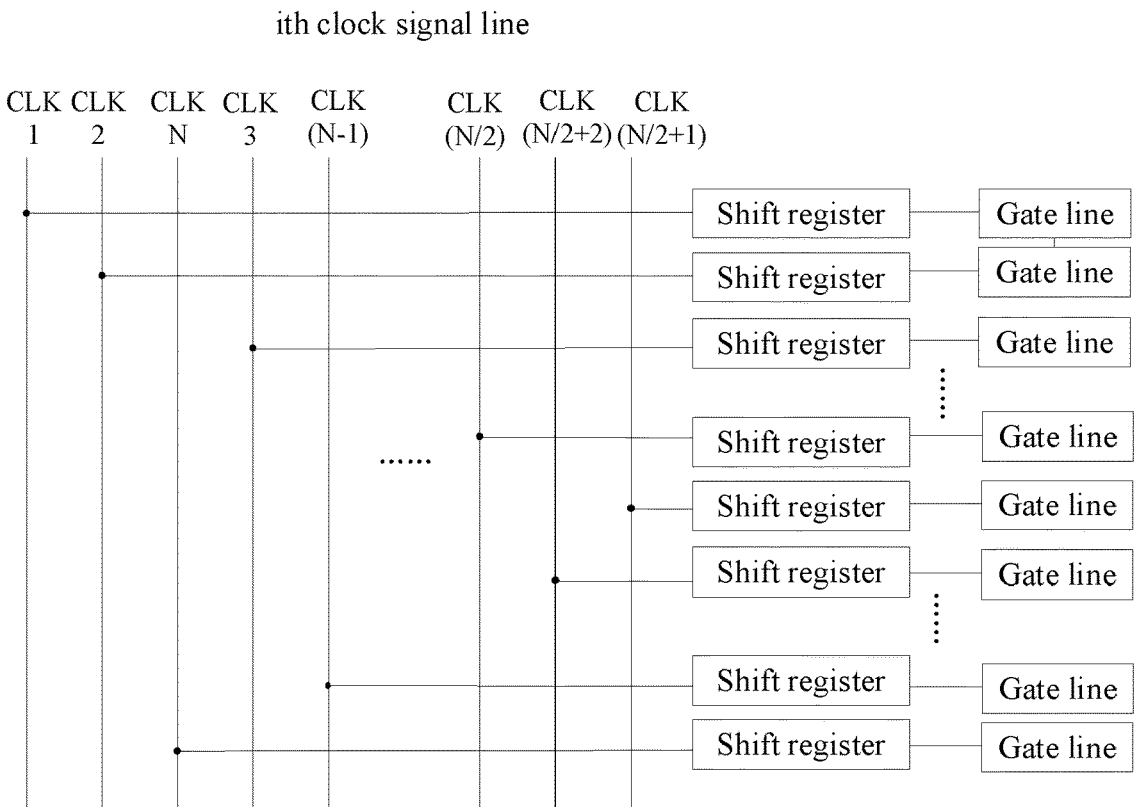
FIGS. 3A and 3B are two schematic wiring diagrams of clock signal lines of a display substrate according to an embodiment of the present disclosure.

In an exemplary embodiment, when N is an even number, a wiring sequence of the N ith clock signal lines CLK1 to CLKN in the first direction may sequentially be ith clock signal line 1 CLK1, ith clock signal line 2 CLK2, ith clock signal line N CLKN, ith clock signal line 3 CLK3, ith clock signal line N−1 CLK(N−1), . . . , ith clock signal line $$\frac{N}{2}CLK\left(\frac{N}{2}\right),$$

ith clock signal line $$\left(\frac{N}{2}+1\right)CLK\left(\frac{N}{2}+1\right),$$

and ith clock signal line $$\left(\frac{N}{2}+2\right)CLK\left(\frac{N}{2}+2\right),$$

as shown in FIG. 3A.

Figure 3B:
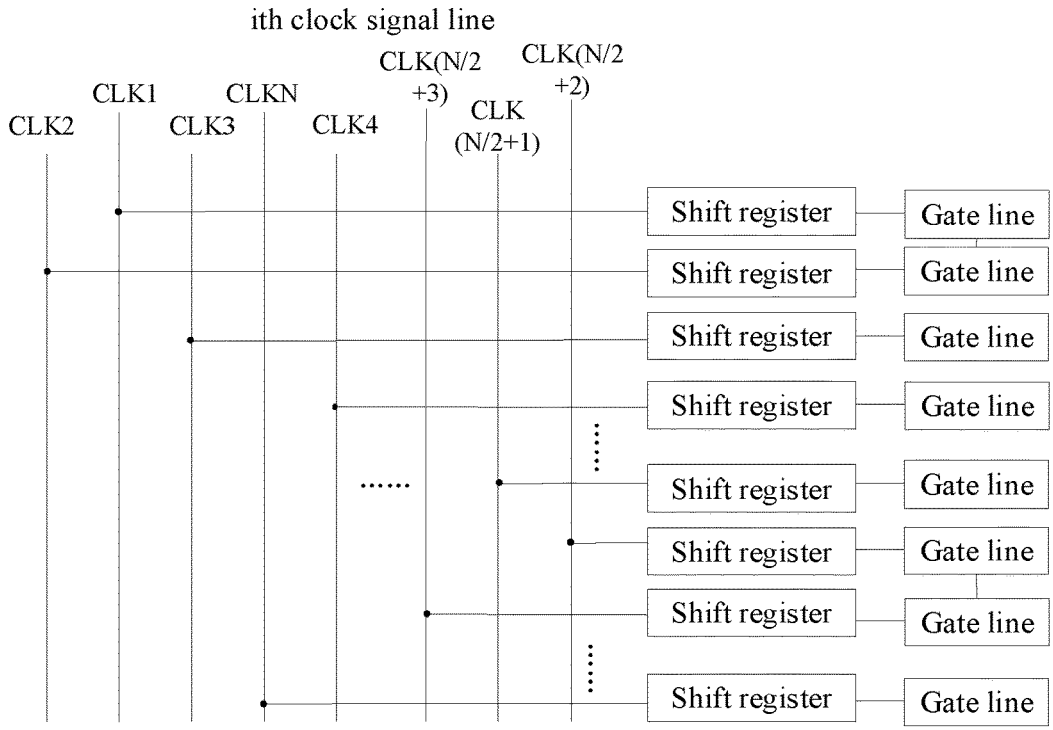

In another exemplary embodiment, when N is an even number, a wiring sequence of the N ith clock signal lines CLK1 to CLKN in the first direction may sequentially be ith clock signal line 2 CLK2, ith clock signal line 1 CLK1, ith clock signal line 3 CLK3, ith clock signal line N CLKN, ith clock signal line 4 CLK4, ith clock signal line (N−1) CLK(N−1), . . . , ith clock signal line $$\frac{N}{2}CLK\left(\frac{N}{2}\right),$$

ith clock signal line $$\left(\frac{N}{2}+3\right)CLK\left(\frac{N}{2}+3\right),$$

ith clock signal line $$\left(\frac{N}{2}+1\right)CLK\left(\frac{N}{2}+1\right),$$

and ith clock signal line $$\left(\frac{N}{2}+2\right)CLK\left(\frac{N}{2}+2\right),$$

as shown in FIG. 3B. The wiring sequence of the ith clock signal lines in FIG. 3B may be considered as being obtained by reversing a wiring sequence of two adjacent ith clock signal lines in FIG. 3A.

Figure 4A:
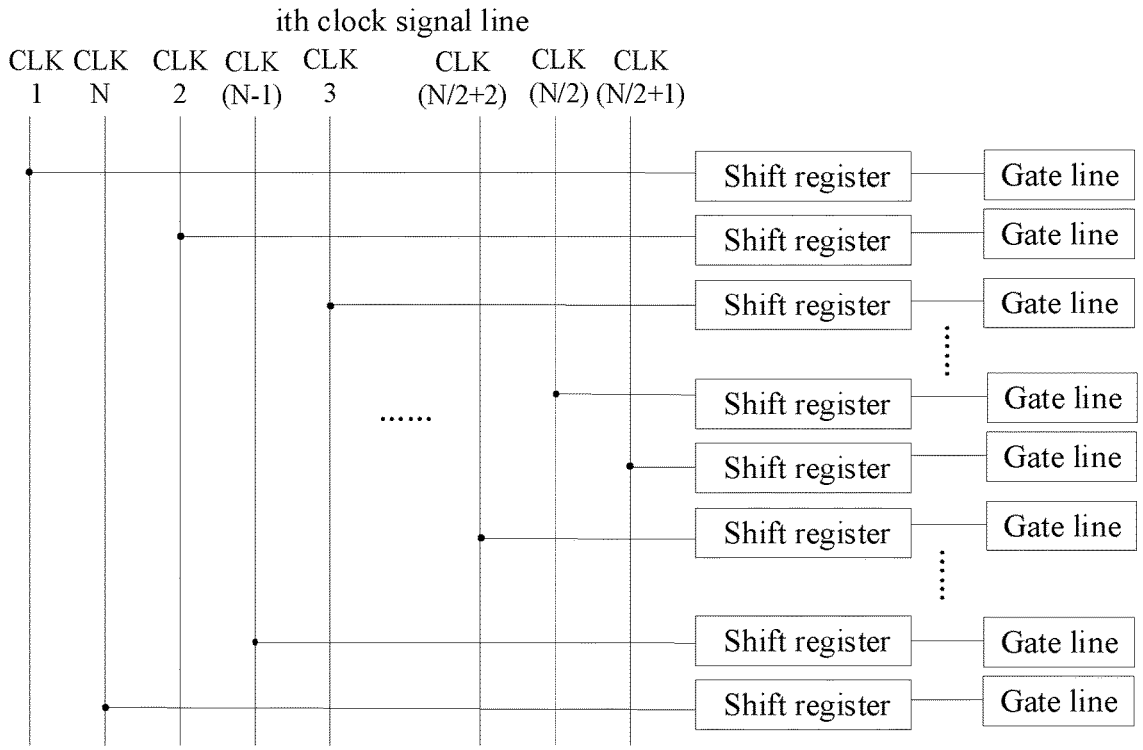
FIGS. 4A and 4B are other two schematic wiring diagrams of clock signal lines of a display substrate according to an embodiment of the present disclosure.

In another exemplary embodiment, when N is an even number, a wiring sequence of the N ith clock signal lines CLK1 to CLKN in the first direction may sequentially be ith clock signal line 1 CLK1, ith clock signal line N CLKN, ith clock signal line 2 CLK2, ith clock signal line (N−1) CLK(N−1), ith clock signal line 3 CLK3, . . . , ith clock signal line $$\left(\frac{N}{2}+2\right)CLK\left(\frac{N}{2}+2\right),$$

ith clock signal line $$\frac{N}{2}CLK\left(\frac{N}{2}\right),$$

and ith clock signal line $$\left(\frac{N}{2}+1\right)CLK\left(\frac{N}{2}+1\right),$$

as shown in FIG. 4A.

Figure 4B:
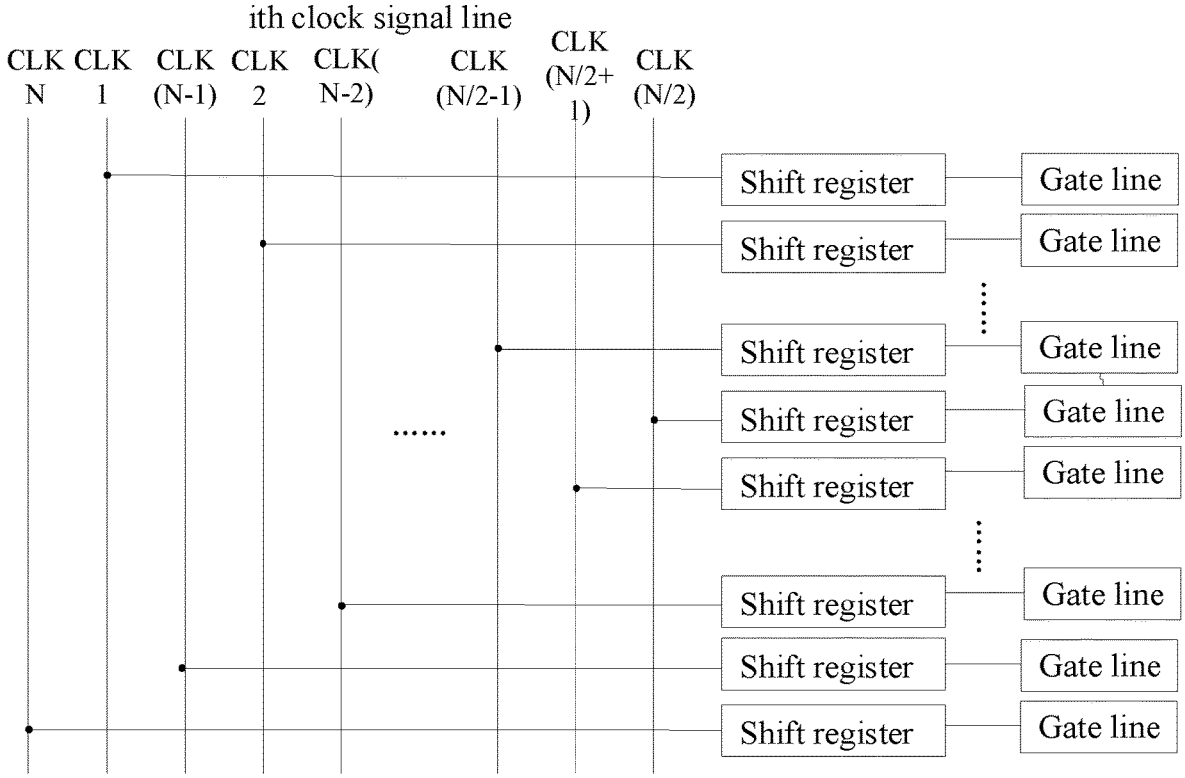

In another exemplary embodiment, when N is an even number, a wiring sequence of the N ith clock signal lines CLK1 to CLKN in the first direction may sequentially be ith clock signal line N CLKN, ith clock signal line 1 CLK1, ith clock signal line (N−1) CLK(N−1), ith clock signal line 2 CLK2, ith clock signal line (N−2) CLK(N−2), ith clock signal line 3 CLK3, . . . , ith clock signal line $$\left(\frac{N}{2}+2\right)CLK\left(\frac{N}{2}+2\right),$$

ith clock signal line $$\left(\frac{N}{2}-1\right)CLK\left(\frac{N}{2}-1\right),$$

ith clock signal line $$\left(\frac{N}{2}+1\right)CLK\left(\frac{N}{2}+1\right),$$

and ith clock signal line $$\frac{N}{2}CLK\left(\frac{N}{2}\right),$$

as shown in FIG. 4B. The wiring sequence of the ith clock signal lines in FIG. 4B may be considered as being obtained by reversing a wiring sequence of two adjacent ith clock signal lines in FIG. 4A.

Figure 5A:
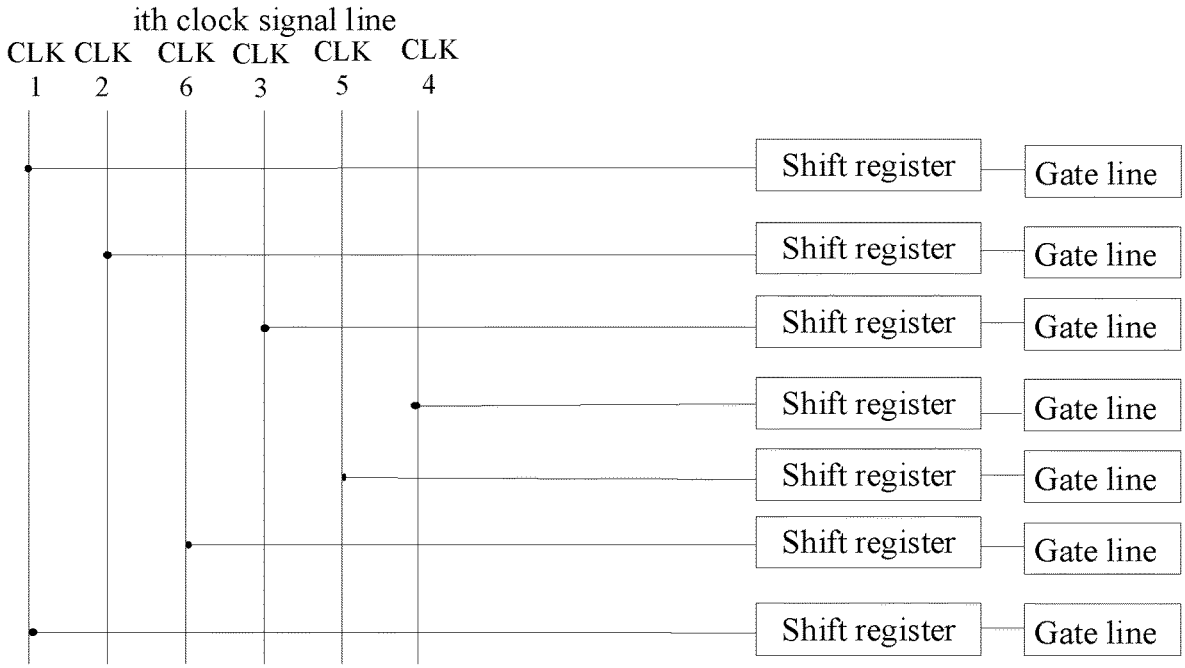
FIGS. 5A and 5B are other two schematic wiring diagrams of clock signal lines of a display substrate according to an embodiment of the present disclosure.
Figure 5B:
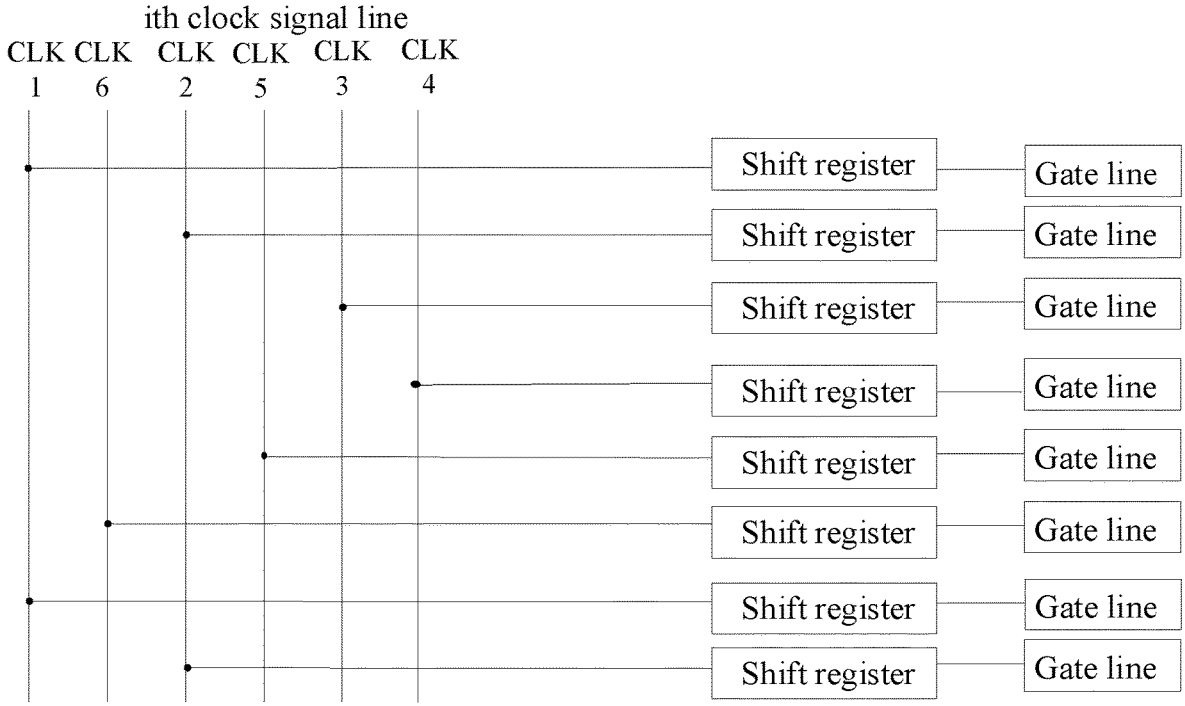

Exemplarily, when N is 6, as shown in FIG. 5A, a wiring sequence of the six ith clock signal lines in the first direction may sequentially be ith clock signal line 1 CLK1, ith clock signal line 2 CLK2, ith clock signal line 6 CLK6, ith clock signal line 3 CLK3, ith clock signal line 5 CLK5, and ith clock signal line 4 CLK4. Alternatively, as shown in FIG. 5B, a wiring sequence of the six ith clock signal lines in the first direction may sequentially be ith clock signal line 1 CLK1, ith clock signal line 6 CLK6, ith clock signal line 2 CLK2, ith clock signal line 5 CLK5, ith clock signal line 3 CLK3, and ith clock signal line 4 CLK4.

Figure 6A:
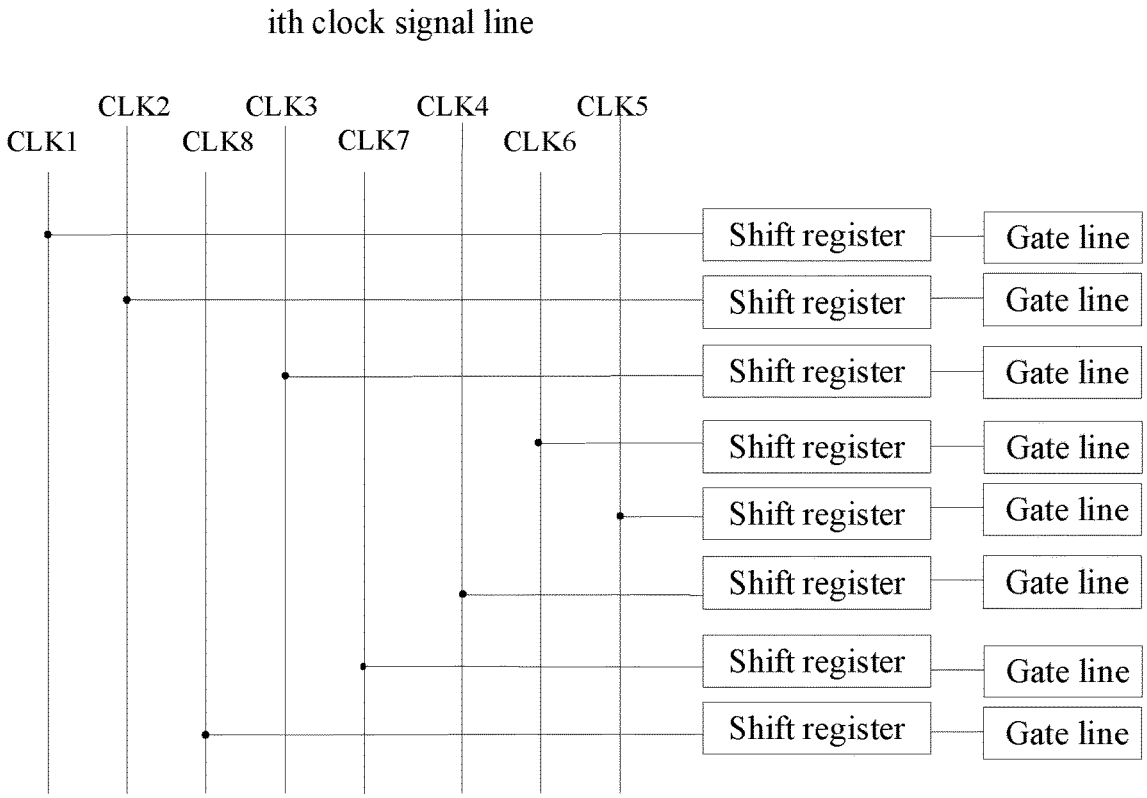
FIGS. 6A, 6B, 6C and 6D are other four schematic wiring diagrams of clock signal lines of a display substrate according to an embodiment of the present disclosure.
Figure 6B:
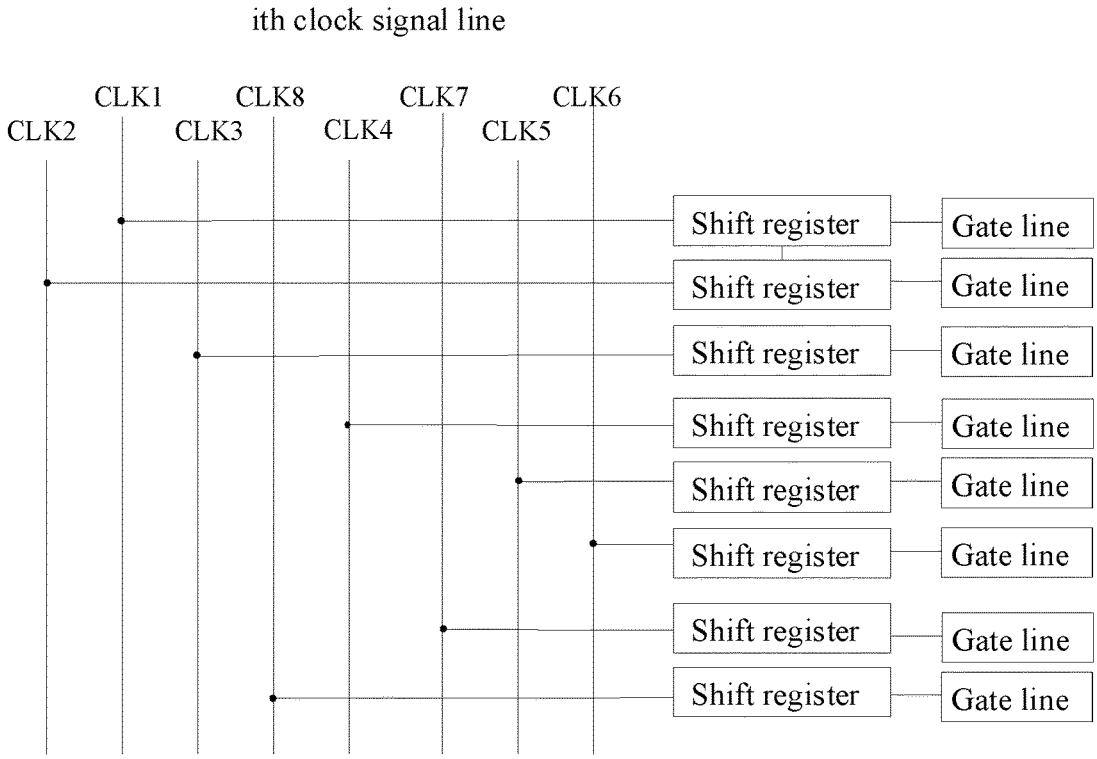
Figure 6C:
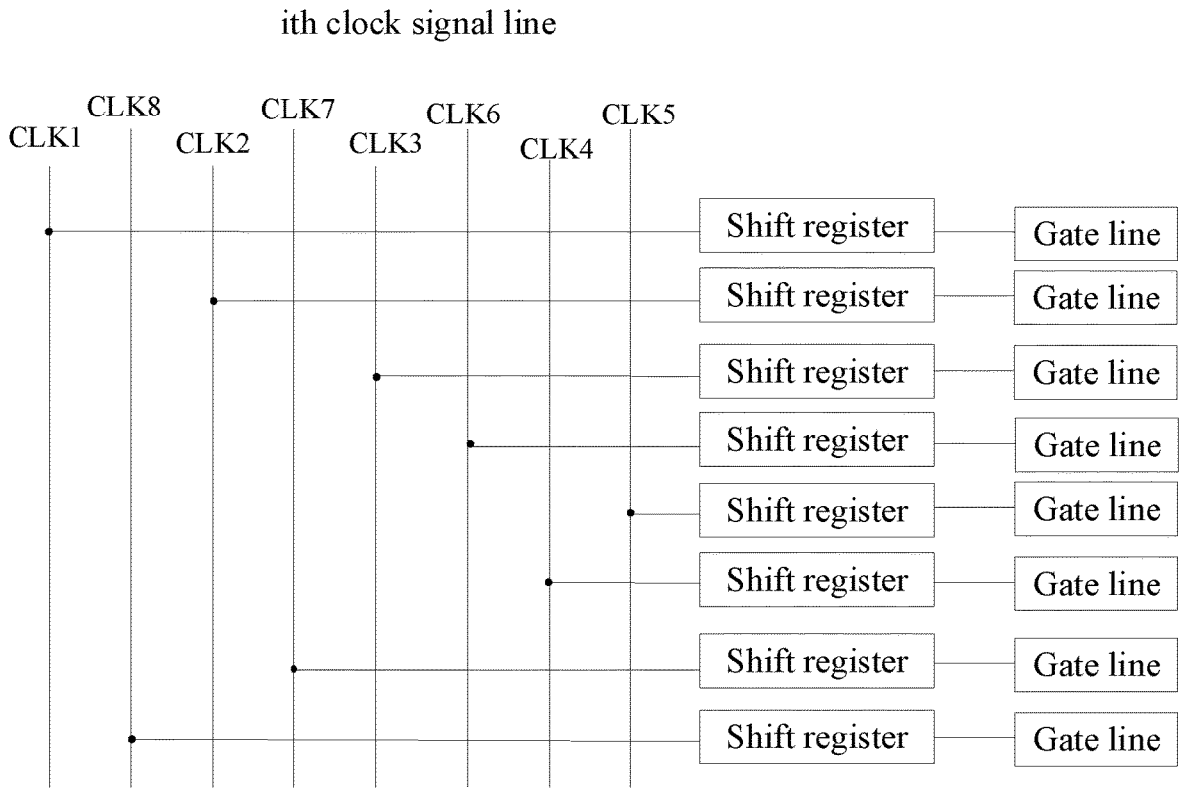
Figure 6D:
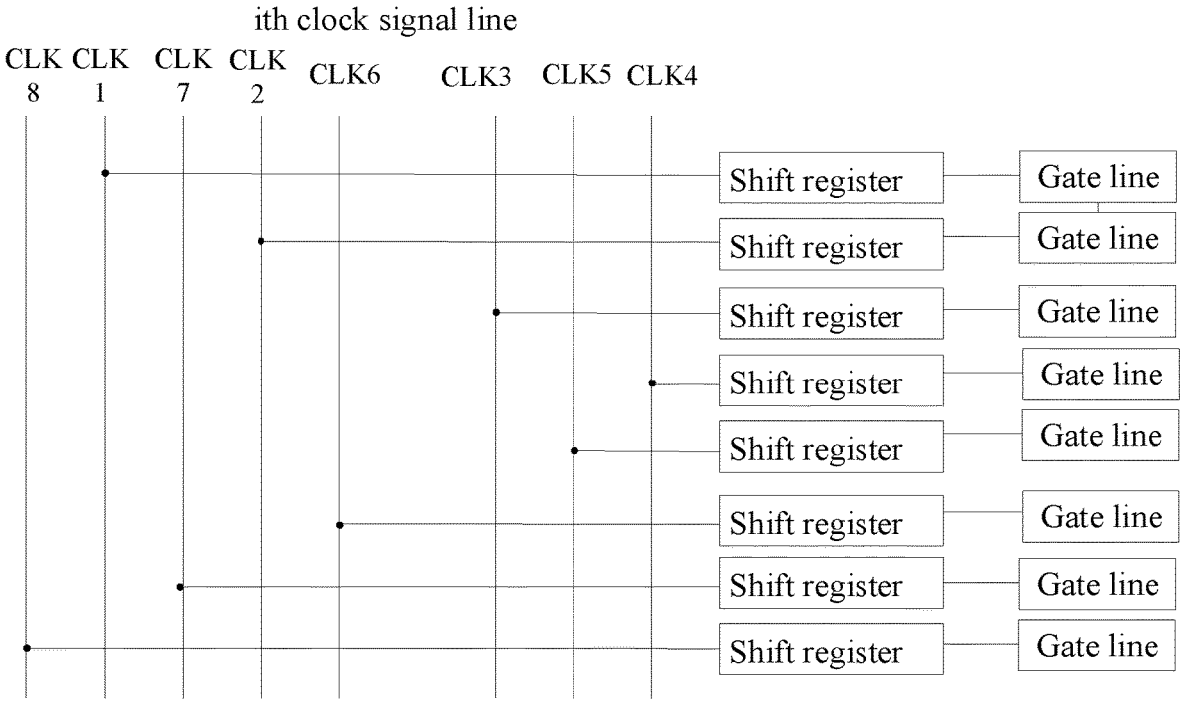

When N is 8, as shown in FIG. 6A, a wiring sequence of the eight ith clock signal lines in the first direction may sequentially be ith clock signal line 1 CLK1, ith clock signal line 2 CLK2, ith clock signal line 8 CLK8, ith clock signal line 3 CLK3, ith clock signal line 7 CLK7, ith clock signal line 4 CLK4, ith clock signal line 6 CLK6, and ith clock signal line 5 CLK5. Alternatively, as shown in FIG. 6B, a wiring sequence of the eight ith clock signal lines in the first direction may sequentially be ith clock signal line 2 CLK2, ith clock signal line 1 CLK1, ith clock signal line 3 CLK3, ith clock signal line 8 CLK8, ith clock signal line 4 CLK4, ith clock signal line 7 CLK7, ith clock signal line 5 CLK5, and ith clock signal line 6 CLK6. Alternatively, as shown in FIG. 6C, a wiring sequence of the eight ith clock signal lines in the first direction may sequentially be ith clock signal line 1 CLK1, ith clock signal line 8 CLK8, ith clock signal line 2 CLK2, ith clock signal line 7 CLK7, ith clock signal line 3 CLK3, ith clock signal line 6 CLK6, ith clock signal line 4 CLK4, and ith clock signal line 5 CLK5. Alternatively, as shown in FIG. 6D, a wiring sequence of the eight ith clock signal lines in the first direction may sequentially be ith clock signal line 8 CLK8, ith clock signal line 1 CLK1, ith clock signal line 7 CLK7, ith clock signal line 2 CLK2, ith clock signal line 6 CLK6, ith clock signal line 3 CLK3, ith clock signal line 5 CLK5, and ith clock signal line 4 CLK4.

When N is 10, a wiring sequence of the ten ith clock signal lines in the first direction may sequentially be ith clock signal line 1 CLK1, ith clock signal line 2 CLK2, ith clock signal line 10 CLK10, ith clock signal line 3 CLK3, ith clock signal line 9 CLK9, ith clock signal line 4 CLK4, ith clock signal line 8 CLK8, ith clock signal line 5 CLK5, ith clock signal line 7 CLK7, and ith clock signal line 6 CLK6. Alternatively, a wiring sequence of the ten ith clock signal lines in the first direction may sequentially be ith clock signal line 1 CLK1, ith clock signal line 10 CLK10, ith clock signal line 2 CLK2, ith clock signal line 9 CLK9, ith clock signal line 3 CLK3, ith clock signal line 8 CLK8, ith clock signal line 4 CLK4, ith clock signal line 7 CLK7, ith clock signal line 5 CLK5, and ith clock signal line 6 CLK6.

When N is 4, a wiring sequence of the four ith clock signal lines in the first direction may sequentially be ith clock signal line 1 CLK1, ith clock signal line 2 CLK2, ith clock signal line 4 CLK4, and ith clock signal line 3 CLK3. Alternatively, a wiring sequence of the four ith clock signal lines in the first direction may sequentially be ith clock signal line 1 CLK1, ith clock signal line 4 CLK4, ith clock signal line 2 CLK2, and ith clock signal line 3 CLK3.

Figure 7:
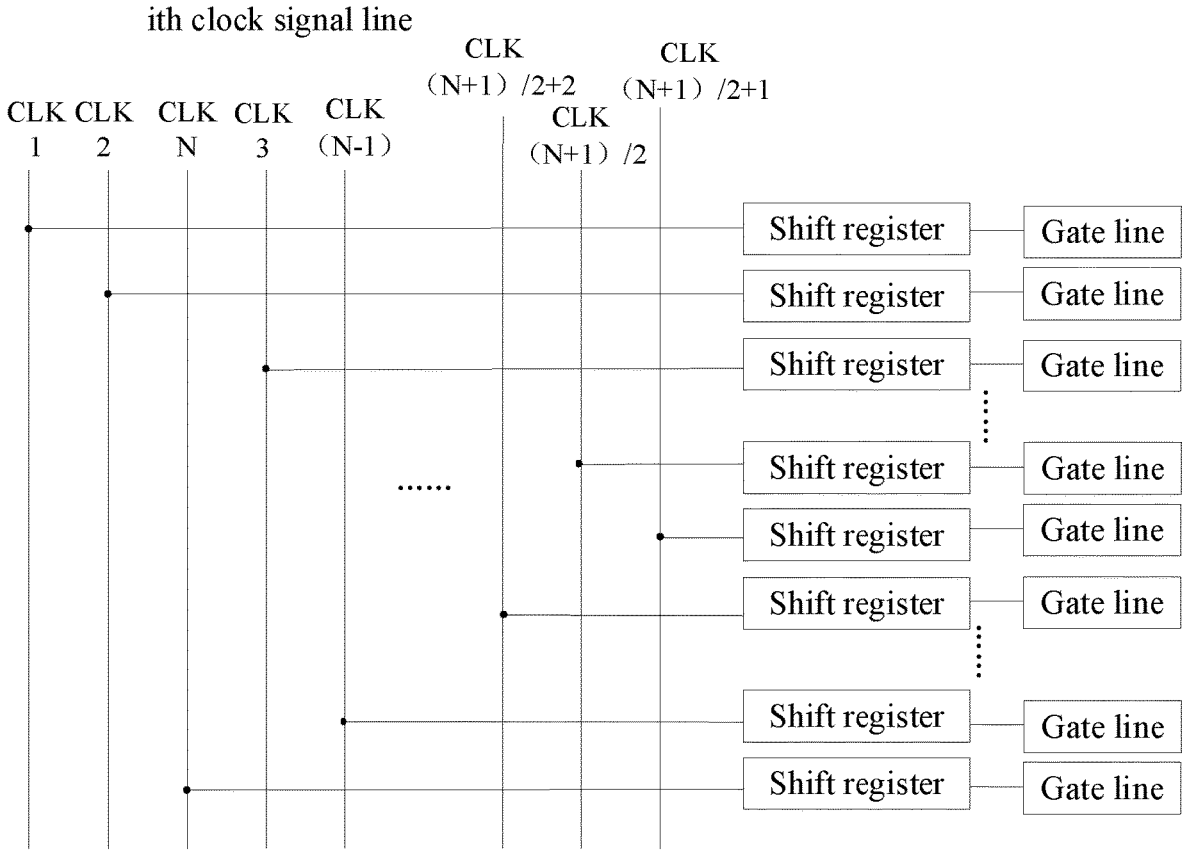
FIG. 7 is another schematic wiring diagram of clock signal lines of a display substrate according to an embodiment of the present disclosure.

In an exemplary embodiment, when N is an odd number, as shown in FIG. 7, a wiring sequence of the N ith clock signal lines CLK1 to CLKN in the first direction may sequentially be ith clock signal line 1 CLK1, ith clock signal line 2 CLK2, ith clock signal line N CLKN, ith clock signal line 3 CLK3, ith clock signal line (N−1) CLK(N−1), . . . , ith clock signal line $$\left(\frac{N+1}{2}+2\right)CLK\left(\frac{N+1}{2}+2\right),$$

ith clock signal line $$\frac{N+1}{2}CLK\left(\frac{N+1}{2}\right),$$

and ith clock signal line $$\left(\frac{N+1}{2}+1\right)CLK\left(\frac{N+1}{2}+1\right),$$

In another exemplary embodiment, when N is an odd number, a wiring sequence of the N ith clock signal lines CLK1 to CLKN in the first direction may sequentially be ith clock signal line 2 CLK2, ith clock signal line 1 CLK1, ith clock signal line 3 CLK3, ith clock signal line N CLKN, ith clock signal line 4 CLK4, ith clock signal line (N−1) CLK(N−1), . . . , ith clock signal line $$\frac{N+1}{2}CLK\left(\frac{N+1}{2}\right),$$

ith clock signal line $$\left(\frac{N+1}{2}+2\right)CLK\left(\frac{N+1}{2}+2\right),$$

and ith clock signal line $$\left(\frac{N+1}{2}+1\right)CLK\left(\frac{N+1}{2}+1\right).$$

The wiring sequence may be considered as being obtained by reversing a wiring sequence of two adjacent ith clock signal lines from ith clock signal line 1 on the leftmost side in FIG. 7.

Figure 8:
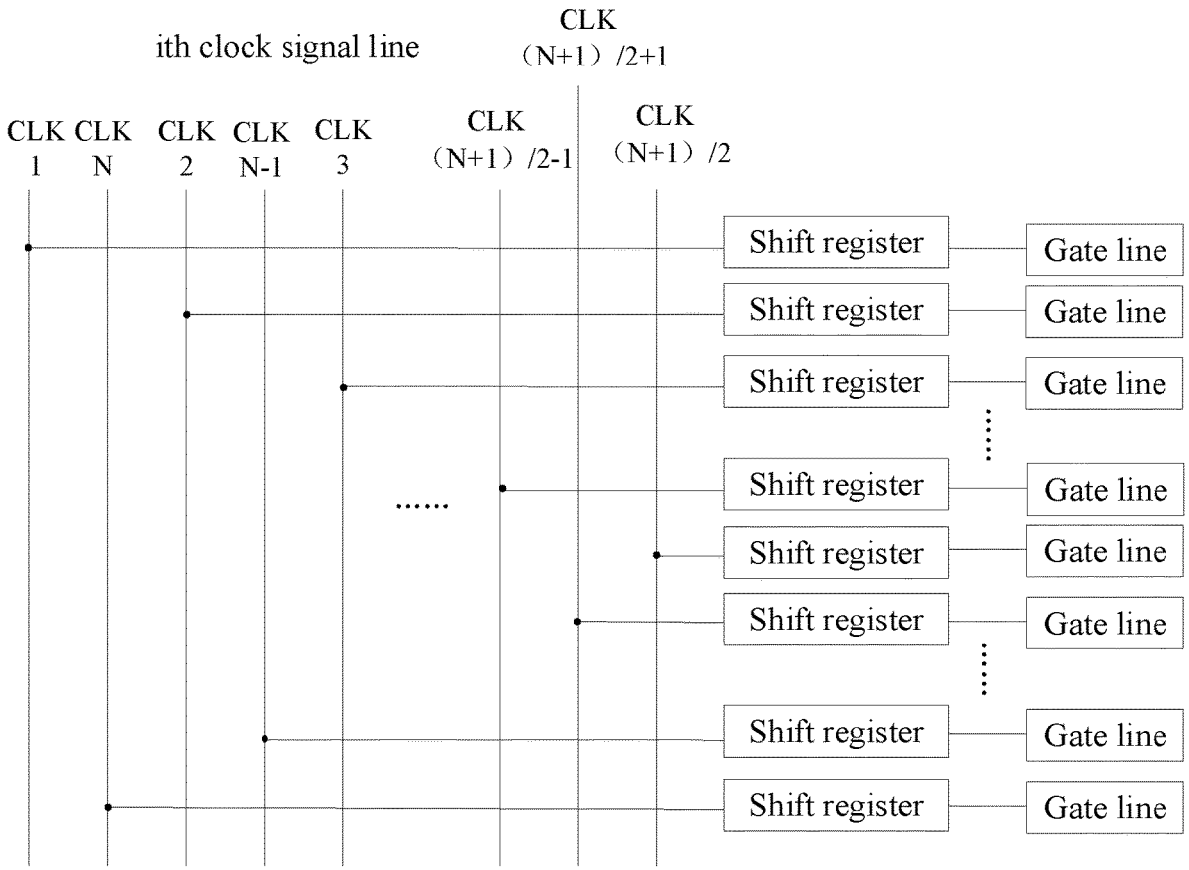
FIG. 8 is another schematic wiring diagram of clock signal lines of a display substrate according to an embodiment of the present disclosure.

In another exemplary embodiment, when N is an odd number, as shown in FIG. 8, a wiring sequence of the N ith clock signal lines CLK1 to CLKN in the first direction may sequentially be ith clock signal line 1 CLK1, ith clock signal line N CLKN, ith clock signal line 2 CLK2, ith clock signal line (N−1) CLK(N−1), ith clock signal line 3 CLK3, . . . , ith clock signal line $$\left(\frac{N+1}{2}-1\right)CLK\left(\frac{N+1}{2}-1\right),$$

ith clock signal line $$\left(\frac{N+1}{2}+1\right)CLK\left(\frac{N+1}{2}+1\right),$$

and ith clock signal line $$\frac{N+1}{2}CLK\left(\frac{N+1}{2}\right).$$

In another exemplary embodiment, when N is an odd number, a wiring sequence of the N ith clock signal lines CLK1 to CLKN in the first direction may sequentially be ith clock signal line N CLKN, ith clock signal line 1 CLK1, ith clock signal line (N−1) CLK(N−1), ith clock signal line 2 CLK2, ith clock signal line (N−2) CLK(N−2), ith clock signal line 3 CLK3, . . . , ith clock signal line $$\left(\frac{N+1}{2}+1\right)CLK\left(\frac{N+1}{2}+1\right),$$

ith clock signal line $$\left(\frac{N+1}{2}-1\right)CLK\left(\frac{N+1}{2}-1\right),$$

and ith clock signal line $$\frac{N+1}{2}CLK\left(\frac{N+1}{2}\right).$$

The wiring sequence may be considered as being obtained by reversing a wiring sequence of two adjacent ith clock signal lines from ith clock signal line 1 on the leftmost side in FIG. 8.

Exemplarily, when N is 5, a wiring sequence of the five ith clock signal lines in the first direction may sequentially be ith clock signal line 1 CLK1, ith clock signal line 2 CLK2, ith clock signal line 5 CLK5, ith clock signal line 3 CLK3, and ith clock signal line 4 CLK4. Alternatively, a wiring sequence of the five ith clock signal lines in the first direction may sequentially be ith clock signal line 2 CLK2, ith clock signal line 1 CLK1, ith clock signal line 3 CLK3, ith clock signal line 5 CLK5, and ith clock signal line 4 CLK4. Alternatively, a wiring sequence of the five ith clock signal lines in the first direction may sequentially be ith clock signal line 1 CLK1, ith clock signal line 5 CLK5, ith clock signal line 2 CLK2, ith clock signal line 4 CLK4, and ith clock signal line 3 CLK3. Alternatively, a wiring sequence of the five ith clock signal lines in the first direction may sequentially be ith clock signal line 5 CLK5, ith clock signal line 1 CLK1, ith clock signal line 4 CLK4, ith clock signal line 2 CLK2, and ith clock signal line 3 CLK3.

When N is 7, a wiring sequence of the seven ith clock signal lines in the first direction may sequentially be ith clock signal line 1 CLK1, ith clock signal line 2 CLK2, ith clock signal line 7 CLK7, ith clock signal line 3 CLK3, ith clock signal line 6 CLK6, ith clock signal line 4 CLK4, and ith clock signal line 5 CLK5. Alternatively, a wiring sequence of the seven ith clock signal lines in the first direction may sequentially be ith clock signal line 1 CLK1, ith clock signal line 7 CLK7, ith clock signal line 2 CLK2, ith clock signal line 6 CLK6, ith clock signal line 3 CLK3, ith clock signal line 5 CLK5, and ith clock signal line 4 CLK4. Alternatively, a wiring sequence of the seven ith clock signal lines in the first direction may sequentially be ith clock signal line 2 CLK2, ith clock signal line 1 CLK1, ith clock signal line 3 CLK3, ith clock signal line 7 CLK7, ith clock signal line 4 CLK4, ith clock signal line 6 CLK6, and ith clock signal line 5 CLK5. Alternatively, a wiring sequence of the seven ith clock signal lines in the first direction may sequentially be ith clock signal line 7 CLK7, ith clock signal line 1 CLK1, ith clock signal line 6 CLK6, ith clock signal line 2 CLK2, ith clock signal line 5 CLK5, ith clock signal line 3 CLK3, and ith clock signal line 4 CLK4.

When N is 9, a wiring sequence of the nine ith clock signal lines in the first direction may sequentially be ith clock signal line 1 CLK1, ith clock signal line 2 CLK2, ith clock signal line 9 CLK9, ith clock signal line 3 CLK3, ith clock signal line 8 CLK8, ith clock signal line 4 CLK4, ith clock signal line 7 CLK7, ith clock signal line 5 CLK5, and ith clock signal line 6 CLK6, or, ith clock signal line 2 CLK2, ith clock signal line 1 CLK1, ith clock signal line 3 CLK3, ith clock signal line 9 CLK9, ith clock signal line 4 CLK4, ith clock signal line 8 CLK8, ith clock signal line 5 CLK5, ith clock signal line 7 CLK7, and ith clock signal line 6 CLK6. Alternatively, a wiring sequence of the nine ith clock signal lines in the first direction may sequentially be ith clock signal line 1 CLK1, ith clock signal line 9 CLK9, ith clock signal line 2 CLK2, ith clock signal line 8 CLK8, ith clock signal line 3 CLK3, ith clock signal line 7 CLK7, ith clock signal line 4 CLK4, ith clock signal line 6 CLK6, and ith clock signal line 5 CLK5. Alternatively, a wiring sequence of the nine ith clock signal lines in the first direction may sequentially be ith clock signal line 9 CLK9, ith clock signal line 1 CLK1, ith clock signal line 8 CLK8, ith clock signal line 2 CLK2, ith clock signal line 7 CLK7, ith clock signal line 3 CLK3, ith clock signal line 6 CLK6, ith clock signal line 4 CLK4, and ith clock signal line 5 CLK5.

Figure 9A:
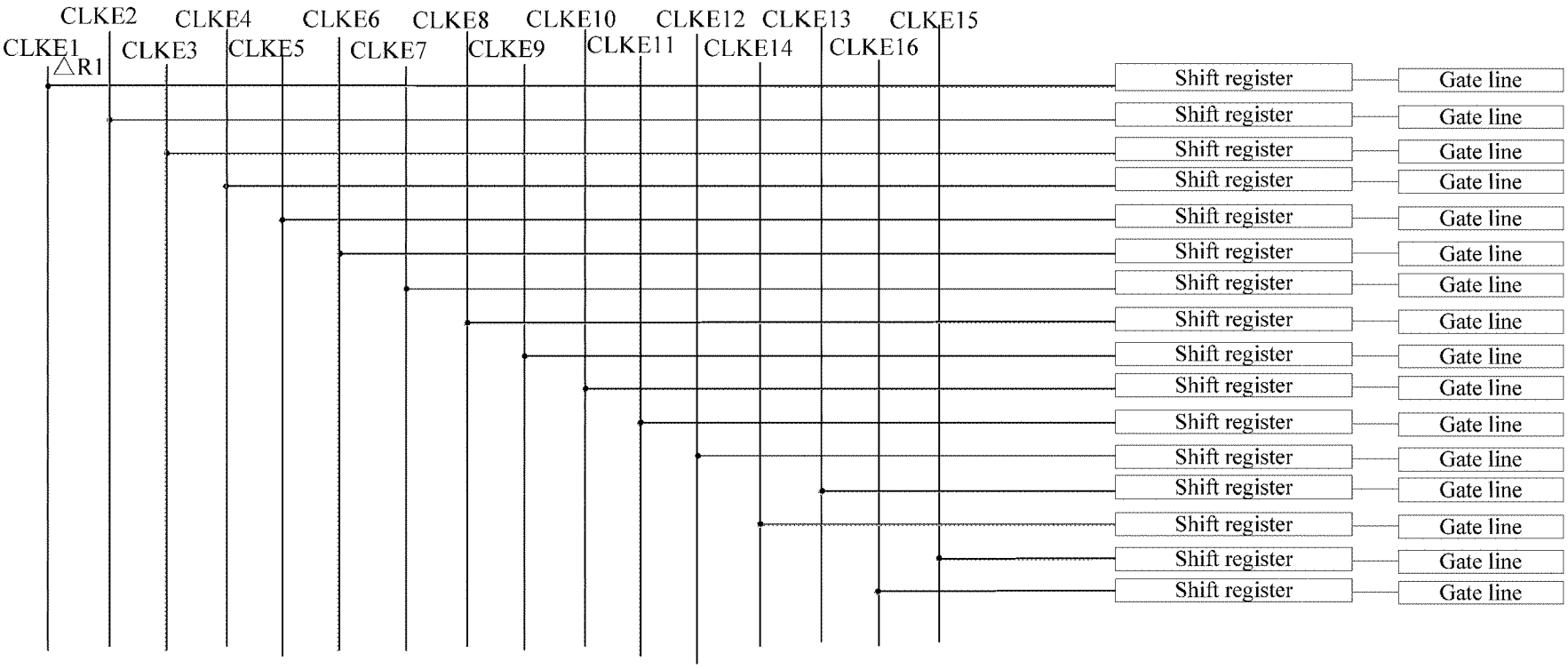
FIGS. 9A, 9B, 9C and 9D are other four schematic wiring diagrams of clock signal lines of a display substrate according to an embodiment of the present disclosure.

In an exemplary embodiment, as shown in FIG. 9A, X=12, and N=4. The X ith clock signal lines include first clock signal line 1 CLKE1 to first clock signal line 12 CLKE12, and N first clock signal lines include first clock signal line 13 CLKE13 to first clock signal line 16 CLKE16. The 16 first clock signal lines (CLKE1 to CLKE16) are on a side of M shift registers away from the display region, M being more than or equal to 16. 16 adjacent shift registers are correspondingly connected with the 16 first clock signal lines one to one. The X first clock signal lines are on a side of the N first clock signal lines away from the shift registers. A wiring sequence of 12 first clock signal lines in the first direction is that first clock signal line 1 CLKE1 to first clock signal line 12 CLKE12 are sequentially arranged. A wiring sequence of the other four first clock signal lines in the first direction is sequentially first clock signal line 14 CLKE14, first clock signal line 13 CLKE13, first clock signal line 16 CLKE16, and first clock signal line 15 CLKE15. The 16 first clock signal lines satisfy that an impedance difference between the first clock signal lines connected with any two adjacent groups of shift registers is less than or equal to 14*ΔR1, where ΔR1 is an impedance difference between two adjacent first clock signal lines in the first direction.

In the present embodiment, the N ith clock signal lines are counted from 13 to 16 according to the wiring sequence. In another embodiment, positions where the counting of the N ith clock signal lines is started and ended may be adaptively modified as required. Similarly, in the present embodiment, the X ith clock signal lines are counted from 1 to 12 according to the wiring sequence. In another embodiment, positions where the counting of the X ith clock signal lines is started and ended may be adaptively modified as required.

In an exemplary embodiment, the clock signal lines include first clock signal lines and second clock signal lines. (X1+N1) first clock signal lines and (X2+N2) second clock signal lines are on a side of M shift registers away from the display region. (X1+N1) adjacent shift registers are correspondingly connected with the (X1+N1) first clock signal lines one to one. (X2+N2) adjacent shift registers are correspondingly connected with the (X2+N2) second clock signal lines one to one. M is more than or equal to (X1+N1) and (X2+N2). X1 and X2 are integers more than or equal to 0. M, N1 and N2 are all positive integers.

N1 first clock signal lines are arranged in a manner that a wiring sequence is adjusted to make an impedance difference between the first clock signal lines connected with any two adjacent shift registers in the shift registers connected with the (X1+N1) first clock signal lines less than or equal to a first impedance threshold.

N2 second clock signal lines are arranged in a manner that a wiring sequence is adjusted to make an impedance difference between the second clock signal lines connected with any two adjacent shift registers in the shift registers connected with the (X2+N2) second clock signal lines less than or equal to a second impedance threshold.

Figure 9B:
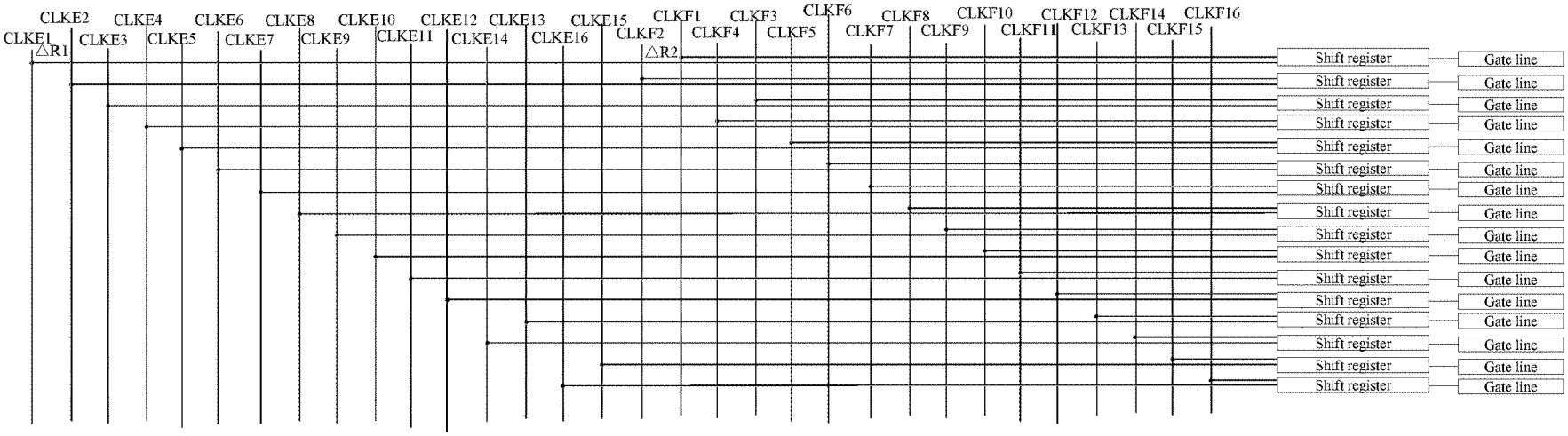

Exemplarily, as shown in FIG. 9B, X1=12, N1=4, X2=12, and N2=4. 16 first clock signal lines (CLKE1 to CLKE16) and 16 second clock signal lines (CLKF1 to CLKF16) are on a side of M shift registers away from the display region. 16 adjacent shift registers are correspondingly connected with the 16 first clock signal lines and the 16 second clock signal lines one to one respectively. A wiring sequence of 12 first clock signal lines in the first direction is that first clock signal line 1 CLKE1 to first clock signal line 12 CLKE12 are sequentially arranged. A wiring sequence of the other four first clock signal lines is sequentially first clock signal line 14 CLKE14, first clock signal line 13 CLKE13, first clock signal line 16 CLKE16, and first clock signal line 15 CLKE15. That is, the 16 first clock signal lines satisfy that an impedance difference between the first clock signal lines connected with any two adjacent groups of shift registers is less than or equal to 14*ΔR1, where ΔR1 is an impedance difference between two adjacent first clock signal lines in the first direction. A wiring sequence of 12 second clock signal lines in the first direction is that second clock signal line 5 CLKF 5 to second clock signal line 16 CLKF16 are sequentially arranged. A wiring sequence of the other four second clock signal lines in the first direction is sequentially second clock signal line 2 CLKF2, second clock signal line 1 CLKF1, second clock signal line 4 CLKF4, and second clock signal line 3 CLKF3. That is, the 16 second clock signal lines satisfy that an impedance difference between the second clock signal lines connected with any two adjacent groups of shift registers is less than or equal to 14*ΔR2, where ΔR2 is an impedance difference between two adjacent second clock signal lines in the first direction.

In the present embodiment, N1 first clock signal lines are counted from 13 to 16 according to the wiring sequence. In another embodiment, positions where the counting of the N1 first clock signal lines is started and ended may be adaptively modified as required. Similarly, in the present embodiment, X1 first clock signal lines are counted from 1 to 12 according to the wiring sequence. In another embodiment, positions where the counting of the X1 first clock signal lines is started and ended may be adaptively modified as required. N2 second clock signal lines are counted from 1 to 4 according to the wiring sequence. In another embodiment, positions where the counting of the N2 second clock signal lines is started and ended may be adaptively modified as required. Similarly, in the present embodiment, X2 second clock signal lines are counted from 13 to 16 according to the wiring sequence. In another embodiment, positions where the counting of the X2 second clock signal lines is started and ended may be adaptively modified as required.

In an exemplary embodiment, the clock signal lines may further include third clock signal lines, and even fourth clock signal lines, fifth clock signal lines, etc. The clock signal lines of each type may be sequenced according to the abovementioned sequencing method. Exemplarily, for zth clock signal lines, Xz zth clock signal lines are selected and arranged one by one in the first direction in a sequence of connection with shift registers. Exemplarily, zth clock signal line 1 to zth clock signal line Xz are sequentially arranged. Nz zth clock signal lines are selected and arranged in a manner that a wiring sequence is adjusted to make an impedance difference between the zth clock signal lines connected with any two adjacent shift registers in shift registers connected with (X+N) zth clock signal lines less than or equal to an impedance threshold. Herein, ΔRz is an impedance difference between two adjacent zth clock signal lines in the first direction, Xz is an integer more than or equal to 0, and both z and Yz are positive integers.

In an exemplary embodiment, the zth clock signal lines may include a plurality of first groups. Each first group includes a plurality of zth clock signal lines arranged adjacently in the first direction. The plurality of first groups are arranged in a manner that a wiring sequence of the zth clock signal lines in each first group is adjusted to make an impedance difference between the zth clock signal lines connected with any two adjacent shift registers in shift registers connected with the (Xz+Nz) zth clock signal lines less than or equal to the impedance threshold.

Figure 9C:
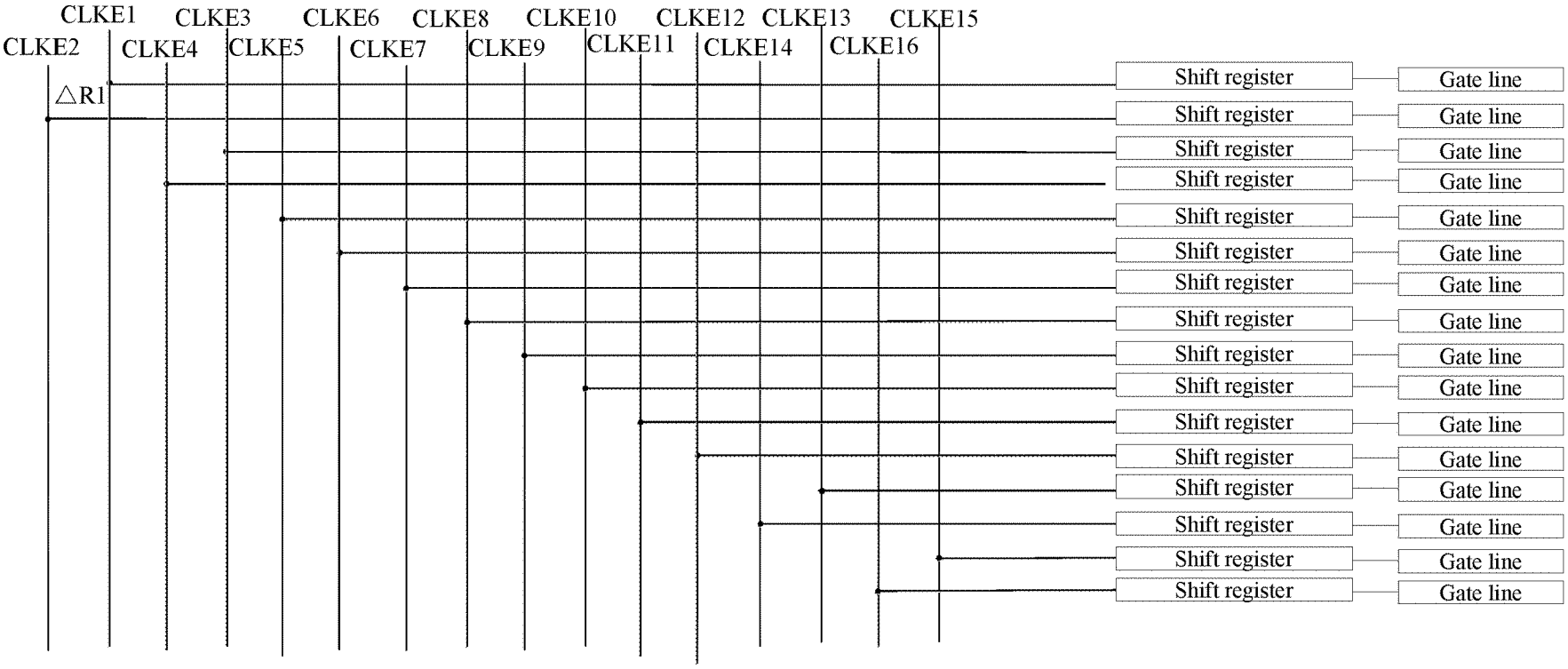

Exemplarily, as shown in FIG. 9C, the first clock signal lines may include two first groups. X=8, and N=8. 16 first clock signal lines (CLKE1 to CLKE16) are on a side of M first shift registers away from the display region. 16 adjacent first shift registers are correspondingly connected with the 16 first clock signal lines one to one. A wiring sequence of eight first clock signal lines in the first direction is that first clock signal line 5 CLKE5 to first clock signal line 12 CLKE12 are sequentially arranged. A wiring sequence of other four first clock signal lines is sequentially first clock signal line 2 CLKE2, first clock signal line 1 CLKE1, first clock signal line 4 CLKE4, and first clock signal line 3 CLKE3. A wiring sequence of the other four first clock signal lines is sequentially first clock signal line 14 CLKE14, first clock signal line 13 CLKE13, first clock signal line 16 CLKE16, and first clock signal line 15 CLKE15. That is, the 16 first clock signal lines (CLKE1 to CLKE16) satisfy that an impedance difference between the first clock signal lines connected with any two adjacent groups of shift registers is less than or equal to 14*ΔR1, where ΔR1 is an impedance difference between two adjacent first clock signal lines in the first direction.

Figure 9D:
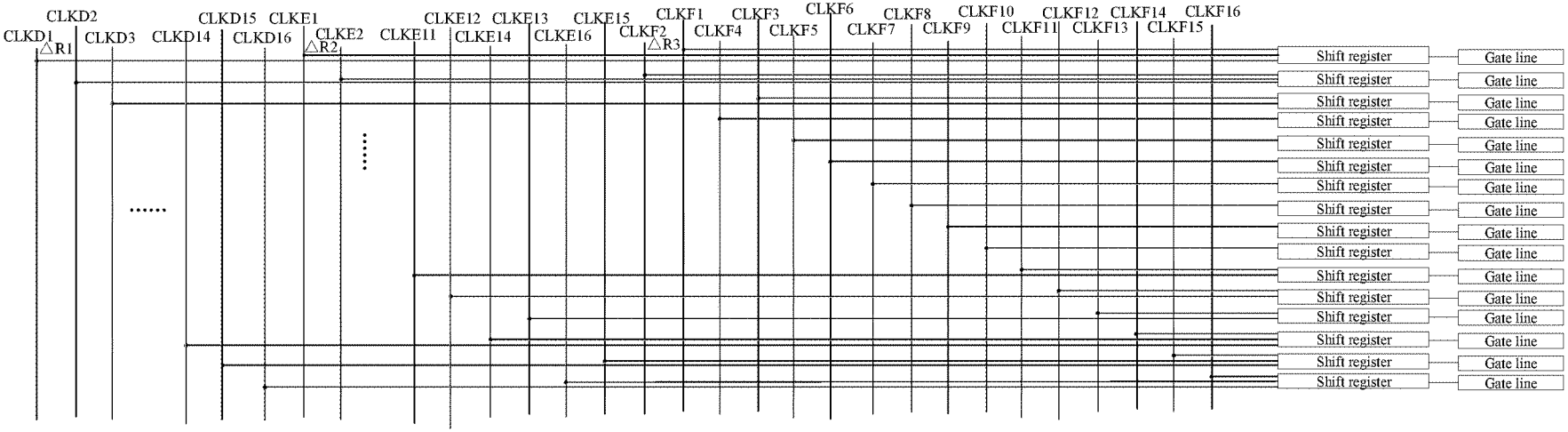

Exemplarily, as shown in FIG. 9D, 16 first clock signal lines (CLKE1 to CLKE16), 16 second clock signal lines (CLKF1 to CLKF16) and 16 third clock signal lines (CLKD1 to CLKD16) are on a side of M shift registers away from the display region. 16 adjacent shift registers are correspondingly connected with the 16 first clock signal lines, the 16 second clock signal lines, and the 16 third clock signal lines one to one respectively. A wiring sequence of 12 first clock signal lines is that first clock signal line 1 CLKE1 to first clock signal line 12 CLKE12 are sequentially arranged. A wiring sequence of the other four first clock signal lines is sequentially first clock signal line 14 CLKE14, first clock signal line 13 CLKE13, first clock signal line 16 CLKE16, and first clock signal line 15 CLKE15. That is, the 16 first clock signal lines satisfy that an impedance difference between the first clock signal lines connected with any two adjacent groups of shift registers is less than or equal to 14*ΔR1, where ΔR1 is an impedance difference between two adjacent first clock signal lines in the first direction. A wiring sequence of 12 second clock signal lines in the first direction is that second clock signal line 5 CLKF 5 to second clock signal line 16 CLKF16 are sequentially arranged. A wiring sequence of the other four second clock signal lines in the first direction is sequentially second clock signal line 2 CLKF2, second clock signal line 1 CLKF1, second clock signal line 4 CLKF4, and second clock signal line 3 CLKF3. That is, the 16 second clock signal lines satisfy that an impedance difference between the second clock signal lines connected with any two adjacent groups of shift registers is less than or equal to 14*ΔR2, where ΔR2 is an impedance difference between two adjacent second clock signal lines in the first direction. A wiring sequence of the 16 third clock signal lines is that third clock signal line 1 CLKD1 to third clock signal line 16 CLKD16 are sequentially arranged.

Figure 10:
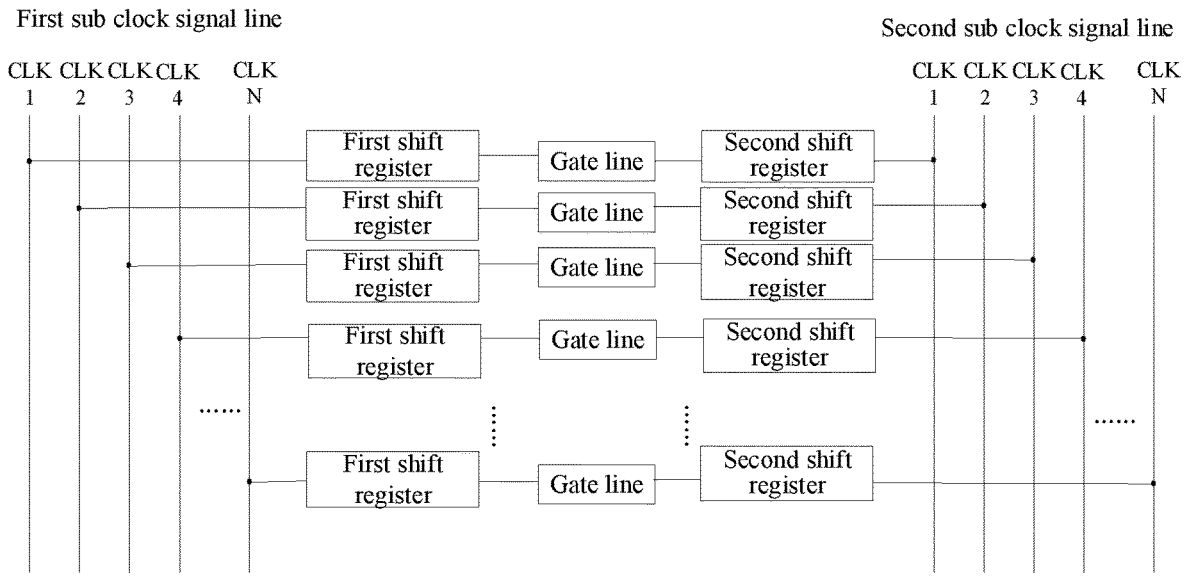
FIG. 10 is another schematic wiring diagram of clock signal lines of a display substrate according to an embodiment of the present disclosure.

As shown in FIG. 10, the display substrate includes a display region and a peripheral region. The peripheral region includes a plurality of groups of shift registers and a plurality of clock signal lines. Each group of shift registers include a first shift register and a second shift register. The clock signal line includes a first sub clock signal line and a second sub clock signal line. Each first shift register and second shift register are connected with a group of gate lines in the display region respectively. N adjacent first shift registers are correspondingly connected with N first sub clock signal lines one to one. N adjacent second shift registers are correspondingly connected with N second sub clock signal lines one to one.

The N first sub clock signal lines are arranged side by side in a first direction and on a side of the first shift registers away from the display region. The N second sub clock signal lines are arranged side by side in the first direction and on a side of the second shift registers away from the display region. The N first sub clock signal lines and the N second sub clock signal lines are arranged in a manner that a wiring sequence is adjusted to make an impedance difference between the clock signal lines connected with any two groups of shift registers less than or equal to an impedance threshold.

For a large-sized FPD product, loads of gate lines are relatively high, a dual-side driving mode is adopted for the shift registers, to normally turn on the gate lines. That is, for gate lines of a row, two shift registers may charge the gate lines on left and right sides respectively. In such case, the shift registers on the left and right sides are designed completely symmetrically. This is called dual-side drive.

In an exemplary embodiment, as shown in FIG. 10, a wiring sequence of the N first sub clock signal lines and the N second sub clock signal lines may be as follows.

The N first sub clock signal lines and the N second sub clock signal lines are in non-display regions on two opposite sides of the display region respectively.

The N first sub clock signal lines are sequentially arranged in a sequence of first sub clock signal line 1 to first sub clock signal line N from a direction away from the display region to a direction close to the display region. The N second sub clock signal lines are sequentially arranged in a sequence of second sub clock signal line 1 to second sub clock signal line N from the direction close to the display region to the direction away from the display region.

In the present embodiment, a signal in first sub clock signal line i is the same as that in second sub clock signal line i.

Figure 11:
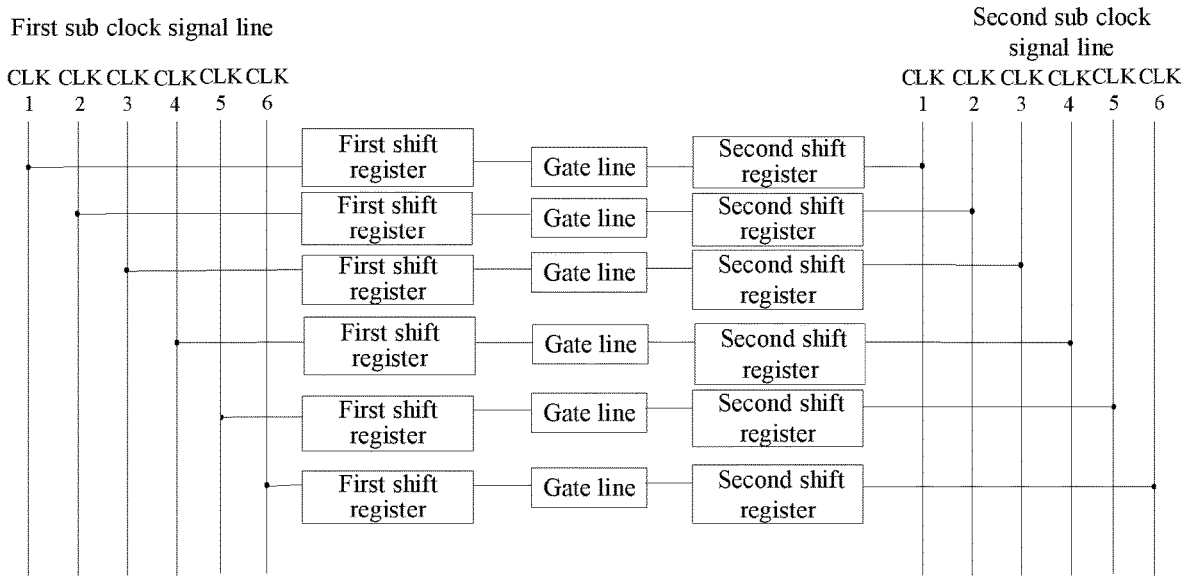
FIG. 11 is another schematic wiring diagram of clock signal lines of a display substrate according to an embodiment of the present disclosure.

Exemplarily, when N is 6, a wiring sequence of the six first sub clock signal lines and the six second sub clock signal lines is shown in FIG. 11.

With the arrangement of the shift registers arranged at both ends for offsetting and the signal lines CLK asymmetrically arranged on the left and the right, values of almost all the rows after ΔVp1 generated at the left end and ΔVp2 generated at the right end are added are substantially the same, so that brightness differences between rows may be improved.

An embodiment of the present disclosure also provides a display device, which includes the display substrate provided in any abovementioned embodiment.

According to the embodiment of the present disclosure, the unconventional arrangement of clock signal lines CLK reduces resistance differences between the clock signal lines CLK of different rows. The differences are controlled in a controllable range, or whole falling edges of gate lines are made completely consistent by the asymmetric arrangement at the two ends, so that the problem of periodic horizontal stripes generated by the differences between the output clock signal lines CLK is solved.

The drawings of the embodiments of the present disclosure only involve the structures involved in the embodiments of the present disclosure, and the other structures may refer to conventional designs.

The embodiments in the present disclosure, i.e., the features in the embodiments, can be combined without conflicts to obtain new embodiments.

Although the implementation modes of the present disclosure are disclosed above, the contents are only implementation modes adopted to easily understand the present disclosure and not intended to limit the present disclosure. Those skilled in the art may make any modifications and variations to implementation forms and details without departing from the spirit and scope disclosed by the present disclosure. However, the patent protection scope of the present disclosure should also be subject to the scope defined by the appended claims.

What is claimed is:

1. A display substrate, comprising:

a display region and a peripheral region, wherein the peripheral region comprises a plurality of shift registers and a plurality of clock signal lines; the plurality of clock signal lines are arranged side by side in a first direction and comprise a first clock signal line to a Zth clock signal line, Z being a positive integer; the shift registers are connected with gate lines in the display region and the first clock signal line to the Zth clock signal line respectively;

wherein there is at least a group of ith clock signal lines satisfying that the ith clock signal lines comprise X ith clock signal lines which are arranged one by one the same as a sequence of connection between the X ith clock signal lines and the shift registers, and further comprise N ith clock signal lines, which are arranged, through a wiring sequence adjusting, in a manner that an impedance difference between the ith clock signal lines connected with any two adjacent shift registers in the shift registers connected with the (X+N) ith clock signal lines is less than or equal to an impedance threshold, i being an integer from 1 to Z, X being an integer greater than 2, and N being a positive integer, and wherein there is at least a group of jth clock signal lines satisfying that:

the jth clock signal lines comprise J jth clock signal lines; and the J jth clock signal lines are arranged one by one the same as a sequence of connection between the J jth clock signal lines and the shift registers, j being an integer from 1 to Z, i≠j, and J being an integer greater than 2.

2. The display substrate according to claim 1, wherein the impedance threshold is k*ΔR, where k is an integer from 2 to (X+N−2), and ΔR is an impedance difference between clock signal lines connected with two adjacent groups of shift registers.

3. The display substrate according to claim 1, wherein the N ith clock signal lines are on a side of the X ith clock signal lines away from the display region.

4. The display substrate according to claim 1, wherein the N ith clock signal lines are on a side of the X ith clock signal lines close to the display region.

5. The display substrate according to claim 1, wherein both the ith clock signal lines and the jth clock signal lines are on one side of the shift registers.

6. The display substrate according to claim 1, wherein the ith clock signal lines comprise a plurality of first groups, each first group comprises a plurality of ith clock signal lines arranged adjacently in the first direction, and the plurality of first groups are arranged, through a wiring sequence of the ith clock signal lines in each first group being adjusted, in a manner that an impedance difference between the ith clock signal lines connected with any two adjacent shift registers in the shift registers connected with the (X+N) ith clock signal lines is less than or equal to the impedance threshold.

7. The display substrate according to claim 1, wherein the ith clock signal lines comprise a plurality of second groups, each second group comprises a plurality of ith clock signal lines arranged adjacently in the first direction, and the ith clock signal lines in each second group are arranged one by one the same as a sequence of connection between the ith clock signal lines and the shift registers.

8. The display substrate according to claim 1, wherein the shift registers comprise a plurality of groups of which each comprises (X+N) shift registers, and (X+N) adjacent shift registers are correspondingly connected with the (X+N) ith clock signal lines one to one.

9. The display substrate according to claim 1, wherein the X ith clock signal lines comprise ith clock signal line 1 to ith clock signal line 12, and the N ith clock signal lines comprise ith clock signal line 13 to ith clock signal line 16;

ith clock signal line 1 to ith clock signal line 12 are arranged one by one the same as a sequence of connection between the ith clock signal line 1 to the ith clock signal line 12 and the shift registers; and ith clock signal line 13 to ith clock signal line 16 are arranged in a sequence of ith clock signal line 14, ith clock signal line 13, ith clock signal line 16 and ith clock signal line 15.

10. The display substrate according to claim 1, wherein the N ith clock signal lines comprise ith clock signal line 1 to ith clock signal line 4, and the X ith clock signal lines comprise ith clock signal line 5 to ith clock signal line 16;

ith clock signal line 5 to ith clock signal line 16 are arranged one by one the same as a sequence of connection between the ith clock signal line 5 to ith clock signal line 16 and the shift registers; and ith clock signal line 1 to ith clock signal line 4 are arranged in a sequence of ith clock signal line 2, ith clock signal line 1, ith clock signal line 4 and ith clock signal line 3.

11. The display substrate according to claim 1, wherein a wiring sequence of the N ith clock signal lines satisfies that impedance differences between ith clock signal line n1 and ith clock signal line (n1+1) and between ith clock signal line 1 and ith clock signal line N are ΔR or 2*ΔR respectively, n1 being an integer from 1 to (N−1).

12. The display substrate according to claim 11, wherein the first direction is a direction close to a first shift register; when N is an even number, a wiring sequence of the N ith clock signal lines in the first direction is sequentially ith clock signal line 1, ith clock signal line 2, ith clock signal line N, ith clock signal line 3, ith clock signal line (N−1), . . . , ith clock signal line N/2, ith clock signal line (N/2+2), and ith clock signal line (N/2+1); or, a wiring sequence of the N ith clock signal lines in the first direction is sequentially ith clock signal line 2, ith clock signal line 1, ith clock signal line 3, ith clock signal line N, ith clock signal line 4, ith clock signal line (N−1), . . . , ith clock signal line N/2, ith clock signal line (N/2+3), ith clock signal line (N/2+1), and ith clock signal line (N/2+2).

13. The display substrate according to claim 11, wherein the first direction is a direction close to a first shift register; when N is an even number, a wiring sequence of the N ith clock signal lines in the first direction is sequentially ith clock signal line 1, ith clock signal line N, ith clock signal line 2, ith clock signal line (N−1), ith clock signal line 3, . . . , ith clock signal line (N/2+2), ith clock signal line N/2, and ith clock signal line (N/2+1); or, a wiring sequence of the N ith clock signal lines in the first direction is sequentially ith clock signal line N, ith clock signal line 1, ith clock signal line (N−1), ith clock signal line 2, ith clock signal line (N−2), ith clock signal line 3, . . . , ith clock signal line (N/2+2), ith clock signal line (N/2−1), ith clock signal line (N/2+1), and ith clock signal line N/2.

14. The display substrate according to claim 11, wherein the first direction is a direction close to a first shift register; when N is an odd number, a wiring sequence of the N ith clock signal lines in the first direction is sequentially ith clock signal line 1, ith clock signal line 2, ith clock signal line N, ith clock signal line 3, ith clock signal line (N−1), . . . , ith clock signal line ((N+1)/2+2), ith clock signal line (N+1)/2, and ith clock signal line ((N+1)/2+1); or, a wiring sequence of the N ith clock signal lines in the first direction is sequentially ith clock signal line 2, ith clock signal line 1, ith clock signal line 3, ith clock signal line N, ith clock signal line 4, ith clock signal line (N−1), . . . , ith clock signal line (N+1)/2, ith clock signal line ((N+1)/2+2), and ith clock signal line ((N+1)/2+1).

15. The display substrate according to claim 11, wherein the first direction is a direction close to a first shift register; when N is an odd number, a wiring sequence of the N ith clock signal lines in the first direction is sequentially ith clock signal line 1, ith clock signal line N, ith clock signal line 2, ith clock signal line (N−1), ith clock signal line 3, . . . , ith clock signal line ((N+1)/2−1), ith clock signal line ((N+1)/2+1), and ith clock signal line (N+1)/2; or, a wiring sequence of the N ith clock signal lines in the first direction is sequentially ith clock signal line N, ith clock signal line 1, ith clock signal line (N−1), ith clock signal line 2, ith clock signal line (N−2), ith clock signal line 3, . . . , ith clock signal line ((N+1)/2+1), ith clock signal line ((N+1)/2−1), and ith clock signal line (N+1)/2.

16. A display device, comprising the display substrate according to claim 1.

* * * * *